US011286652B2

(12) United States Patent
Miller et al.

(10) Patent No.: US 11,286,652 B2
(45) Date of Patent: Mar. 29, 2022

(54) APRON FRONT SINK WITH INTERCHANGEABLE FACES

(71) Applicant: Kohler Co., Kohler, WI (US)

(72) Inventors: Jason R. Miller, Elkhart Lake, WI (US); Ryan R. Detlaff, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 16/545,084

(22) Filed: Aug. 20, 2019

(65) Prior Publication Data

US 2020/0063412 A1 Feb. 27, 2020

Related U.S. Application Data

(60) Provisional application No. 62/720,568, filed on Aug. 21, 2018.

(51) Int. Cl.
*E03C 1/182* (2006.01)

(52) U.S. Cl.
CPC ..... *E03C 1/182* (2013.01)

(58) Field of Classification Search
CPC ..... E03C 1/18; E03C 1/182
USPC ..... 4/619
See application file for complete search history.

(56) References Cited

U.S. PATENT DOCUMENTS

| | | | |
|---|---|---|---|
| 208,094 | A | 9/1878 | Higgins |
| 526,390 | A | 9/1894 | Glauber |
| 594,962 | A | 12/1897 | McManus |
| 792,498 | A | 6/1905 | Carr |
| 832,309 | A | 10/1906 | Frey |
| 915,057 | A | 3/1909 | Monahan |
| 948,954 | A | 2/1910 | Cody |
| 958,857 | A | 5/1910 | Dennis |
| 981,448 | A | 1/1911 | Matthews |
| 1,006,994 | A | 10/1911 | Barnes |
| 1,225,308 | A | 5/1917 | Born |
| 1,408,812 | A | 3/1922 | Leighton |
| 1,576,607 | A | 3/1926 | Hasskarl |
| 1,579,374 | A | 4/1926 | Leighton |
| 1,587,693 | A | 6/1926 | Beland |
| 1,618,032 | A | 2/1927 | Wilkes |
| 1,880,733 | A | 10/1932 | Bolhuis |

(Continued)

FOREIGN PATENT DOCUMENTS

| | | | |
|---|---|---|---|
| CN | 1757837 | A | 4/2006 |
| CN | 1938495 | A | 3/2007 |

(Continued)

OTHER PUBLICATIONS

"BLANCO ONE™ Super Single Bowl," retrieved from https://www.blanco.com/en_us/en_us/sinks/product_catalog/sink.html?SID=BLANCO ONE Super Single Bowl&filter=true, 3 pages (no date).

(Continued)

*Primary Examiner* — Christine J Skubinna
(74) *Attorney, Agent, or Firm* — Foley & Lardner LLP

(57) ABSTRACT

A sink is provided that includes a basin configured to hold water; an apron extending from a front of the basin and having a plurality of walls and a rear surface defining an opening in a front of the apron; and a panel assembly removably received in the opening, wherein an outer perimeter of the panel assembly is spaced apart from an inner perimeter of the plurality of walls of the apron.

19 Claims, 11 Drawing Sheets

(56) References Cited

U.S. PATENT DOCUMENTS 1,986,935 A 1/1935 Levine
2,005,459 A 6/1935 Finn
2,045,965 A 6/1936 Rosen
2,065,347 A 12/1936 Schulse
2,098,374 A 11/1937 Bullock
2,131,111 A 9/1938 Marsh
2,141,347 A 12/1938 Davis
2,194,343 A 3/1940 Wexler
2,308,123 A 1/1943 Stein
2,309,851 A 2/1943 Kuhne
2,341,093 A 2/1944 Haberstump
2,367,161 A 1/1945 Wild
2,441,752 A 5/1948 Campbell
2,457,918 A 1/1949 Pierce
2,473,862 A 6/1949 Clawsey
2,508,808 A 5/1950 Warman
2,510,238 A 6/1950 Mau
2,534,793 A 12/1950 Olson
2,597,925 A 5/1952 Edger
2,668,300 A 2/1954 Grill
2,691,237 A 10/1954 Heim
2,818,579 A 1/1958 Katz
2,825,177 A 3/1958 Nordlof
2,853,750 A 9/1958 Davies et al.
D184,799 S 4/1959 Clemens
D188,090 S 6/1960 Rasmussen
2,977,082 A 3/1961 Harris
2,988,755 A 6/1961 Roland
3,023,991 A 3/1962 Fisher
3,051,160 A 8/1962 Nielsen
3,070,812 A 1/1963 Skrmetta
3,142,295 A 7/1964 Blee
3,169,743 A 2/1965 Page, Jr.
3,204,601 A 9/1965 Staver
3,289,218 A 12/1966 Mehlos
3,289,990 A 12/1966 Grantham
3,472,391 A 10/1969 Bolognesi
3,502,384 A 3/1970 Gipson
D217,164 S 4/1970 Jarema
3,508,282 A 4/1970 Phillips
D218,330 S 8/1970 Hagopian
3,552,705 A 1/1971 Caster
D222,087 S 9/1971 Hagopian
3,625,162 A 12/1971 Crew
D223,501 S 4/1972 Hamburg
3,680,152 A 8/1972 Farrell
3,742,965 A 7/1973 Hudziak
3,813,706 A 6/1974 Williams
3,827,020 A 7/1974 Okamoto
4,033,461 A 7/1977 Nevai
4,041,964 A 8/1977 Shamoon
4,082,391 A 4/1978 Turner
D249,207 S 9/1978 Emmer
4,114,967 A 9/1978 Weekly
D253,147 S 10/1979 Heckler
D253,148 S 10/1979 Heckler
D253,149 S 10/1979 Heckler
4,207,975 A 6/1980 Arzillo
4,305,166 A 12/1981 Rose
4,351,073 A 9/1982 Elsas
4,357,957 A 11/1982 Bisonaya et al.
4,370,762 A 2/1983 Heil
4,387,738 A 6/1983 Bisonaya et al.
4,456,021 A 6/1984 Leavens
4,458,705 A 7/1984 Cawood
D277,820 S 3/1985 Maayeh
4,531,246 A 7/1985 Earley
4,698,861 A 10/1987 Bogusz
4,720,879 A 1/1988 Rabban
4,884,714 A 12/1989 Bechtel
5,012,537 A 5/1991 Underwood
5,181,285 A 1/1993 Kolada
5,199,119 A 4/1993 Weber
5,217,123 A 6/1993 Riley et al.
5,232,189 A 8/1993 Koch
5,239,711 A 8/1993 Tafur
5,253,752 A 10/1993 Jang
D341,049 S 11/1993 Hugh
5,275,363 A 1/1994 Dennis
5,279,007 A 1/1994 Kolada
5,367,278 A 11/1994 Yoshikawa
5,368,268 A 11/1994 Jodwischat
D353,652 S 12/1994 Dannenberg
5,377,941 A 1/1995 Har et al.
D358,457 S 5/1995 Dannenberg
5,417,397 A 5/1995 Harnett
D365,235 S 12/1995 Jodwischat
5,485,859 A 1/1996 Johnson et al.
5,485,927 A 1/1996 Hubbard
D375,219 S 11/1996 Selent
5,590,804 A 1/1997 Crum et al.
5,642,871 A 7/1997 Repert et al.
5,715,547 A 2/1998 Becker et al.
5,864,898 A 2/1999 Knapp et al.
5,865,325 A 2/1999 Comstock
5,940,906 A * 8/1999 Halloran ..... A47K 3/161 4/584
5,947,439 A 9/1999 Florey
D421,490 S 3/2000 Talerico
6,062,397 A 5/2000 Licari
6,092,772 A 7/2000 Garcia et al.
6,154,895 A 12/2000 Pisklak
6,212,707 B1 4/2001 Thompson et al.
6,216,992 B1 4/2001 Bisonaya et al.
6,223,362 B1 5/2001 Liang
D444,216 S 6/2001 Katz et al.
D444,548 S 7/2001 Katz et al.
D444,549 S 7/2001 Katz et al.
6,276,675 B1 8/2001 Shamoon
D451,585 S 12/2001 Svendsen et al.
6,330,948 B1 12/2001 Leto
6,338,171 B1 1/2002 Dandridge
6,341,704 B1 1/2002 Michel, Jr.
6,341,770 B1 1/2002 Landherr
D458,493 S 6/2002 Cascio
D458,494 S 6/2002 Cascio
6,446,280 B1 9/2002 Moore, Jr.
D473,294 S 4/2003 Genslak et al.
6,543,071 B1 4/2003 Lenner
6,557,956 B2 5/2003 Hightower
6,564,398 B1 5/2003 Trott
D477,949 S 8/2003 Cascio et al.
D477,950 S 8/2003 Cascio et al.
D478,444 S 8/2003 Cascio et al.
6,619,604 B1 9/2003 Stillman
6,658,677 B2 12/2003 Paul
D484,956 S 1/2004 Rachiele
D492,983 S 7/2004 Rachiele
D494,257 S 8/2004 Moran et al.
D494,665 S 8/2004 Herbeau
6,793,190 B2 9/2004 White
6,793,193 B2 9/2004 Groote
6,808,147 B2 10/2004 Brannen et al.
D498,291 S 11/2004 Bayer
D499,468 S 12/2004 Trepanier
D499,799 S 12/2004 Trepanier
D499,800 S 12/2004 Trepanier
D501,041 S 1/2005 Moran et al.
D501,541 S 2/2005 Gordon
6,857,616 B1 2/2005 Gasperi et al.
6,910,604 B2 6/2005 Gugliotti et al.
D507,041 S 7/2005 Douglass et al.
D508,984 S 8/2005 Gordon
6,929,232 B1 8/2005 Gasperi et al.
6,991,200 B2 1/2006 Stillman
D518,560 S 4/2006 Arkay-Leliever
D520,611 S 5/2006 Wozniczka
D520,612 S 5/2006 Wozniczka
7,039,963 B2 5/2006 Loberger et al.
D525,689 S 7/2006 Wozniczka
7,086,099 B2 8/2006 Rocci
D527,808 S 9/2006 Wozniczka
D529,148 S 9/2006 Douglass
D529,999 S 10/2006 Lonnerman et al.

(56) References Cited

U.S. PATENT DOCUMENTS

D530,001 S 10/2006 Lonnerman et al.
D530,403 S 10/2006 Lonneman et al.
D530,404 S 10/2006 Lonneman et al.
D530,405 S 10/2006 Douglass et al.
D530,797 S 10/2006 Lonnerman et al.
D537,149 S 2/2007 Douglass et al.
7,178,886 B2 2/2007 Hightower
D537,997 S 3/2007 Plikuhn
D538,497 S 3/2007 Plikuhn
D539,396 S 3/2007 Plikuhn et al.
D544,074 S 6/2007 Douglass et al.
D545,408 S 6/2007 Plikuhn
D545,409 S 6/2007 Plikuhn
D546,426 S 7/2007 Plikuhn
D546,929 S 7/2007 Schneider et al.
D547,838 S 7/2007 Plikuhn
7,246,387 B2 7/2007 Erickson et al.
D548,311 S 8/2007 Mahon
D551,742 S 9/2007 Plikuhn
D552,222 S 10/2007 Tortorello
7,278,175 B2 10/2007 Torres
D556,297 S 11/2007 Baade et al.
D556,848 S 12/2007 Ruggiero et al.
D556,868 S 12/2007 Tortorello
D558,311 S 12/2007 Adams
7,305,723 B2 12/2007 Fulks
D559,366 S 1/2008 Chong
7,377,661 B2 5/2008 Douglass
D573,701 S 7/2008 Rachiele
7,424,949 B2 9/2008 Kumar
D585,126 S 1/2009 Eilmus et al.
7,481,473 B1 1/2009 Warning
D587,789 S 3/2009 Drake
D587,790 S 3/2009 Tortorello et al.
D588,677 S 3/2009 Drake
D588,678 S 3/2009 Chong
D588,679 S 3/2009 Cheng
D588,680 S 3/2009 Cheng
D588,685 S 3/2009 Chong
D589,222 S 3/2009 Gicela et al.
7,503,534 B2 3/2009 Pollack
7,568,239 B2 8/2009 Spruner von Mertz et al.
7,578,399 B1 8/2009 Mulaw
D600,334 S 9/2009 Chong
D603,334 S 9/2009 Suzuki
7,594,706 B2 9/2009 Styka et al.
D603,026 S 10/2009 Deboer et al.
D603,027 S 10/2009 DeBoer et al.
D603,029 S 10/2009 Bucher
D603,486 S 11/2009 Mayer et al.
7,699,277 B2 4/2010 Bagnall
7,721,362 B2 5/2010 Martin et al.
7,726,521 B2 6/2010 Bassett et al.
7,731,846 B1 6/2010 Jones
7,735,661 B1 6/2010 Sumner et al.
D624,635 S 9/2010 Eckhaus
D627,449 S 11/2010 Eckhaus
7,841,473 B2 11/2010 Huang et al.
7,854,030 B2 12/2010 Lee et al.
D636,138 S 4/2011 Talerico
8,070,148 B2 12/2011 Nishida
D651,699 S 1/2012 Booth et al.
8,088,468 B2 1/2012 Maggio
8,096,678 B2 1/2012 Jones et al.
D655,798 S 3/2012 Miller et al.
D657,028 S 4/2012 Eilmus
8,185,980 B2 5/2012 Adams et al.
D662,574 S 6/2012 Booth et al.
D663,389 S 7/2012 Miller et al.
D663,395 S 7/2012 Miller et al.
8,214,939 B2 7/2012 Spurlock
8,296,876 B2 10/2012 Yang et al.
D670,364 S 11/2012 Miller et al.
D670,366 S 11/2012 Booth et al.
D670,367 S 11/2012 Miller et al.
D671,197 S 11/2012 Miller et al.
D675,300 S 1/2013 Miller et al.
8,393,022 B2 3/2013 Dachowski
D682,998 S 5/2013 Eilmus
D685,456 S 7/2013 Eckhaus
D685,457 S 7/2013 Eckhaus
8,484,916 B2 7/2013 Farag
8,511,762 B2 8/2013 Stegerwald
D698,905 S 2/2014 Ziemann et al.
D699,012 S 2/2014 Ziemann et al.
D699,013 S 2/2014 Ziemann et al.
D699,330 S 2/2014 Ziemann et al.
D700,301 S 2/2014 Rachiele
8,684,192 B1 4/2014 Margolin
8,801,926 B2 8/2014 Housley
8,844,070 B2 9/2014 Booth et al.
8,870,306 B2 10/2014 Simon
8,925,124 B2 1/2015 Littlehorn, Sr.
D722,145 S 2/2015 Morales et al.
D725,757 S 3/2015 Morales et al.
9,032,567 B1 5/2015 Galgano
9,066,631 B2 6/2015 Didehvar et al.
9,073,096 B2 7/2015 Ehman
9,085,884 B2 7/2015 Lopchinsky
9,115,484 B2 8/2015 Fulford et al.
9,173,487 B2 11/2015 Booth et al.
9,226,621 B1 1/2016 Jones et al.
9,228,331 B1 1/2016 Weinstein
9,238,907 B2 1/2016 Murray
9,260,845 B1 2/2016 Siegel
9,291,301 B2 3/2016 Brinkmann
9,380,917 B2 7/2016 Eilmus et al.
9,414,717 B2 8/2016 Tollasepp et al.
9,416,538 B2 * 8/2016 Torres ..... A47K 3/161
9,427,135 B2 8/2016 Audet et al.
9,567,735 B2 2/2017 Siegel
9,574,333 B2 2/2017 O'Brien et al.
9,622,621 B2 4/2017 Brinkmann
9,708,064 B2 7/2017 Vandewall et al.
9,750,375 B2 9/2017 Byun
D799,648 S 10/2017 Chong
D799,649 S 10/2017 Chong
9,775,470 B2 10/2017 Eilmus et al.
9,783,967 B2 10/2017 Jain et al.
9,790,671 B2 10/2017 Jones et al.
9,808,123 B1 11/2017 Brinkmann
D804,620 S 12/2017 Palazzolo et al.
D816,197 S 4/2018 Chong et al.
9,930,998 B2 4/2018 Palazzolo et al.
D821,670 S 6/2018 Lynch
D824,628 S 7/2018 Lynch
10,092,097 B2 10/2018 Booth et al.
10,151,085 B2 12/2018 Chong et al.
D845,451 S 4/2019 Swilley
D861,837 S 10/2019 Chong et al.
D865,138 S 10/2019 Lyons
10,501,919 B2 * 12/2019 Chong ..... E03C 1/335
2004/0016052 A1 1/2004 Domenig
2005/0044625 A1 3/2005 Kommers
2005/0155147 A1 7/2005 Trepanier et al.
2005/0223486 A1 10/2005 Jumalon
2007/0157378 A1 7/2007 Kendall et al.
2009/0094741 A1 4/2009 Valadez et al.
2009/0139023 A1 6/2009 Talerico
2009/0172876 A1 7/2009 Hendrickson et al.
2009/0314730 A1 12/2009 Mansikkamaa
2010/0072147 A1 3/2010 Reenberg et al.
2010/0116955 A1 5/2010 Hayes et al.
2010/0148896 A1 6/2010 Hugo
2010/0213145 A1 8/2010 Swank
2010/0254125 A1 10/2010 Jones et al.
2010/0275367 A1 11/2010 Bager et al.
2010/0275368 A1 11/2010 Miller et al.
2010/0275369 A1 11/2010 Eilmus et al.
2011/0056016 A1 3/2011 Mun
2011/0101199 A1 5/2011 Andrade
2011/0163510 A1 7/2011 Wedi
2011/0219535 A1 9/2011 Bouroullec et al.
2011/0303626 A1 12/2011 Roenne

(56) References Cited

U.S. PATENT DOCUMENTS

| | | | |
|---|---|---|---|
| 2012/0169192 | A1 | 7/2012 | Simon |
| 2012/0222211 | A1 | 9/2012 | Booth et al. |
| 2012/0240330 | A1 | 9/2012 | Fulford et al. |
| 2013/0337220 | A1 | 12/2013 | Janke |
| 2014/0041113 | A1 | 2/2014 | Mobbs |
| 2014/0245533 | A1 | 9/2014 | Lee et al. |
| 2014/0259381 | A1 | 9/2014 | Fogerlie |
| 2014/0346102 | A1 | 11/2014 | Housley |
| 2014/0366263 | A1 | 12/2014 | Thompson et al. |
| 2015/0122961 | A1 | 5/2015 | Batiste et al. |
| 2015/0128339 | A1 | 5/2015 | Warner |
| 2015/0230667 | A1 | 8/2015 | Palazzolo et al. |
| 2015/0284937 | A1 | 10/2015 | Baier et al. |
| 2016/0045027 | A1 | 2/2016 | Alkoby |
| 2016/0215484 | A1 | 7/2016 | Williams |
| 2016/0235201 | A1 | 8/2016 | Soot |
| 2016/0256804 | A1 | 9/2016 | Medeiros |
| 2017/0027387 | A1 | 2/2017 | Lakshmi Narasimhan et al. |
| 2017/0130433 | A1 | 5/2017 | Franco |
| 2017/0172379 | A1 | 6/2017 | Keller et al. |
| 2017/0245693 | A1 | 8/2017 | Palazzolo et al. |
| 2017/0295960 | A1 | 10/2017 | Allen |
| 2018/0030702 | A1 | 2/2018 | Childs et al. |
| 2018/0030703 | A1 | 2/2018 | Cagliari et al. |
| 2018/0030704 | A1 | 2/2018 | Bomatter et al. |
| 2018/0030705 | A1 | 2/2018 | Bomatter et al. |
| 2018/0125305 | A1 | 5/2018 | Richards |
| 2018/0187400 | A1 | 7/2018 | Chong |
| 2018/0187401 | A1 | 7/2018 | Chong |
| 2018/0187403 | A1 | 7/2018 | Chong |
| 2020/0063412 | A1 | 2/2020 | Miller et al. |
| 2020/0352331 | A1 | 11/2020 | Graf |

FOREIGN PATENT DOCUMENTS

| | | | |
|---|---|---|---|
| CN | 102105642 | A | 6/2011 |
| CN | 102791919 | A | 11/2012 |
| CN | 104912281 | A | 9/2015 |
| CN | 105496036 | A | 4/2016 |
| CN | 105908812 | A | 8/2016 |
| CN | 207285669 | | 5/2018 |
| DE | 26 58 193 | B1 | 7/1978 |
| DE | 39 28 806 | A1 | 11/1990 |
| EP | 1 442 691 | A1 | 8/2004 |
| FR | 2887416 | B1 | 11/2008 |
| JP | 937863 | A | 2/1997 |
| JP | H0937863 | A | 2/1997 |
| JP | H119487 | A | 1/1999 |
| JP | H119488 | A | 1/1999 |
| JP | H11-346951 | A | 12/1999 |
| JP | 5088124-62 | | 12/2012 |
| WO | WO 2012/069682 | A1 | 5/2012 |
| WO | WO-2012/134118 | A2 | 10/2012 |
| WO | WO-2016/062519 | A1 | 4/2016 |

OTHER PUBLICATIONS

"ELXUFP3620: Elkay Quartz Luxe 35-7/8" ×20-15/16" ×9" Single Bowl Farmhouse Sink with Perfect Drain," retrieved from https://www.elkay.com/products/elxufp3620.html, 2 pages (no date).

Bellucci 30" Flat Apron Front Granite Quartz Composite Single Bowl Kitchen Sink in Brown, https://www.kraususa.com/kraus-kgf1-30brown-30-flat-apron-front-granite-quartz-composite-single-bowl-kitchen-sink-in-brown.html, accessed Sep. 14, 2020, pp. 1-4.

Bellucci 30" Flat Apron Front Granite Quartz Composite Single Bowl Kitchen Sink in White, https://www.kraususa.com/kraus-kgf1-30white-30-flat-apron-front-granite-quartz-composite-single-bowl-kitchen-sink-in-white.html, accessed Sep. 14, 2020, pp. 1-4.

Bellucci 30" Flat Apron Granite Quartz Composite Single Bowl Kitchen Sink in Black, https://www.kraususa.com/kraus-kgf1-30black-30-flat-apron-front-granite-quartz-composite-single-bowl-kitchen-sink-in-black.html, accessed Sep. 14, 2020, pp. 1-4.

Bellucci 33" Flat Apron Front Granite Quartz Composite Single Bowl Kitchen Sink in Black, https://www.kraususa.com/kraus-kgf1-33black-33-flat-apron-front-granite-quartz-composite-single-bowl-kitchen-sink-in-black.html, accessed Sep. 14, 2020. pp. 1-5.

Bellucci 33" Flat Apron Front Granite Quartz Composite Single Bowl kitchen Sink in Brown, https://www.kraususa.com/kraus-kgf1-33brown-33-flat-apron-front-granite-quartz-composite-single-bowl-kitchen-sink-in-brown.html, accessed Sep. 14, 2020, pp. 1-4.

Bellucci 33" Flat Apron Front Granite Quartz Composite Single Bowl Kitchen Sink in White, Model KGF1-33, https://www.kraususa.com/kraus-kgf1-33white-33-flat-apron-front-granite-quartz-composite-single-bowl-kitchen-sink-in-white.html, accessed Sep. 14, 2020, pp. 1-5.

Bellucci by Kraus—Flat Apron-Front Farmhouse Kitchen Sink Video Snippets, https://www.youtube.com/watch?v=bzwDrUpAPUg, accessed Sep. 14, 2020, pp. 1-7.

Bellucci Workstation 33" Quartz Composite Single Bowl Farmhouse Kitchen Sink in Metallic Brown, https://www.kraususa.com/kraus-kgf2-33mbr-workstation-33-quartz-composite-single-bowl-farmhouse-kitchen-sink-in-metallic-brown.html, accessed Sep. 14, 2020. pp. 1-4.

Bellucci Workstation 33" Quartz Composite Single Bowl Farmhouse Kitchen Sink in Metallic Grey, https://www.kraususa.com/kraus-kgf2-33mgr-workstation-33-quartz-composite-single-bowl-farmhouse-kitchen-sink-in-metallic-grey.html, accessed Sep. 14, 2020, pp. 1-4.

BLANCO America, "BLANCO's New ONE Stainless Steel Sinks," retrieved from https://youtu.be/ITta7oPFXgA, pp. 1-19 (2014).

FIFTV Kitchen & Bath Fixtures from Kraus USA Video Snippets, https://www.youtube.com/watch?v=48iJF4PKAqA, accessed Sep. 14, 2020, pp. 1-16.

Kore Workstation 30" Apron Front 16 Guage Stainless Steel Single Bowl Kitchen Sink, https://www.kraususa.com/kraus-kwf410-30-workstation-30-apron-front-16-gauge-stainless-steel-single-bowl-kitchen-sink.html, accessed Sep. 14, 2020, pp. 1-4.

Kraus Bellucci Sink Collection Video Snippets, https://www.youtube.com/watch?v=O_MFn1JLOTg#action=share, accessed Sep. 14, 2020, pp. 1-8.

Kraus Forteza KGF1-33 Farmhouse Apron Kitchen Sink, https://www.wayfair.com/home-improvement/pdp/kraus-forteza-33-l-x-21-w-farmhouseapron-kitchen-sink-kus10133.html?piid=40371630, accessed Sep. 14, 2020, pp. 1-9.

Kraus Installation Guide, "Bellucci Quartz Granite Composite Farmhouse Sink with CeramTek," KGF1-30/KGF1-33, www.kraususa.com, Dec. 3, 2018, pp. 1-15.

Kraus Installation Guide, "Bellucci Quartz Granite Composite Farmhouse Sink," KGF1-30 / KGF1-33, KGF2-30 / KGF2-33, KGF11-30 / KGF11-33, KGF12-30/ KGF12-33, www.kraususa.com, Feb. 19, 2019, pp. 1-15.

Kraus Installation Guide, "Bellucci Quartz Granite Composite Farmhouse Sink," KGF1-30/KGF1-33, KGF2-30/KGF2-33, KGF11-30/KGF11-33, KGF12-30/KGF12-33, www.kraususa.com, Feb. 19, 2019, 1-15.

Kraus Specification Sheet, "KGF1-33 33 Inch Single Bowl Granite Farmhouse Apron Kitchen Sink," www.kraususa.com, Jun. 10, 2019, 1 page.

Linkasink Farm House Kitchen Sink with Inset Apron Front, C071-30 SS, https://static1.squarespace.eom/static/5706844ee707eb7087c2faa7/t/590781fde5b6c7f60ac7e2f/1493664254854/c071-30_ss_spec_sheet.pdf, accessed Dec. 15, 2020, pp. 1-3.

Standart PRO 33" Flat Apron Front 16 Guage Stainless Steel Single Bowl Kitchen Sink, Model KHF410-33, https://www.kraususa.com/kraus-khf410-33-33-flat-apron-front-16-gauge-stainless-steel-single-bowl-kitchen-sink.htmi, accessed Sep. 14, 2020, pp. 1-4.

Wobane Under Cabinet Lighting Kit, https://www.amazon.com/Lighting-Flexible-LED-Cupboard-WarmWhite/dp/B07BF5PB4G/ref=pd_bxgy_img_2/130-1786452-9365555?_encoding=UTF8&pd_rd_i=B07BF5PB4G&pd_rd_r=28e0b463-27d9-4394-bb05-97c57e6bfb1c&pd_rd_w=kLfbC&pd_rd_wg=3R6PF&pf_rd_p=4e3f7fc3-00c8-46a6-a4db-8457e6319578&pf_rd_r=0F23CBD7138W0BTR097T&psc=1&refRID=0F23CBD7138W0BTR097T, pp. 1-12, accessed Jun. 18, 2020.

(56) References Cited

OTHER PUBLICATIONS https://youtu.be/ITta7oPFXgA; accessed May 1, 2021.
https://www.youtube.com/watch?v=48iJF4PKAgA; accessed Jan. 5, 2021.
Foreign Action other than Search Report on CN 201910763481.4 dated Jul. 30, 2020, (11 pages).
Screen capture from Dawn USA showing HTML coding with product installation manual date. Retrieved from http://dawnusa.net/productsee4. Screen capture from amazon. com showing earliest available date for sink model DAF3320C dated Oct. 16, 2017 (2 pages).
Belle Foret. "Apron Front Kitchen Sink". Model No. BFF1KIT. BelleForet.com online catalog. All Contents Copyright, Your 'Other Warehouse. (1 page).
Elite Bath Chameleon Stainless, http://elitebath.com/stainless.html, accessed Apr. 19, 2021, pp. 1-2.
Instawares.com. GSW Stainless Steel Corner Drain Sink Bowl—18.times.24in. Instawares.com online catalog. (1 page).
Kallista. "For Loft by Michael S. Smith Fireclay Kitchen Sink with Drajnboard." Model No. L20300. Kallista.com online catalog. Copyright 2011 Kohler Co. (2 pages).
Kallista. "For Loft by Michael S. Smith Fireclay Kitchen Sink." Model No. L20301. Kallista.com online catalog. Copyright 2011 Kohler Co. (2 pages).
Kallista. "For Town by Michael S. Smith Fireclay Kitchen Sink." Model No. L20303. Kallista.com online catalog. Copyright 2011 Kohler Co. (2 pages).
Kohler Co. "Dickinson Apron-Front, Tile-in Kitchen Sink". Model No. K-6546-3. Kohler Co. online catalog. Copyright 2011 Kohler Co. (3 pages).
Kohler Co. "Dickinson Apron-Front, Tile-in Kitchen Sink". Model No. K-6546-4. Kohler Co. online catalog. Copyright 2011 Kohler Co. (3 pages).
Kohler Co. "Dickinson Apron-Front, Tile-in Kitchen Sink". Model No. K-6546-4U. Kohler Co. online catalog. Copyright 2011 Kohler Co. (3 pages).
Kohler Co. "Hawthorne Apron-Front, Tile-in Kitchen Sink". Model No. K-6534-3. Kohler Co. online catalog. Copyright 2011 Kohler Co.. (3 pages).
Kohler Co. "Hawthorne Apron-Front, Tile-in Kitchen Sink". Model No. K-6534-4. Kohler Co. online catalog. Copyright 2011 Kohler Co. (3 pages).
Kohler Co. "Hawthorne Apron-Front, Tile-in Kitchen Sink". Model No. K-6534-4U. Kohler Co. online catalog. Copyright 2011 Kohler Co. (3 pages).
Kohler Fixtures, Apron Front Sinks, pp. 352-355 (2014).
Lyons. "Premium 34 .times. 23 Apron Sink". Model No. KSxxAP3.4. Lyons brochure. (3 pages).
Rachiele; "Patented copper apron front sink with channel;" http://www.rachiele.com/copper.sub.--apron.sub.--sinks-with-patent.asp; retrieval date: Nov. 30, 2011; 3 pages.
Rohl. Apron Front Sink. (4 pages).
Shaws Original. Apron Sink. (1 page).
Songbath.com. Apron Front Kitchen Sink. Songbath.com online catalog. (1 page).
Texas Lightsmith Luminescent Sinks, https://www.texaslightsmith.com/luminescent-sinks/, accessed Apr. 19, 2021, pp. 1-32.
Chinese Second Office Action on CN Patent Application No. 201910763481.4 dated Mar. 11, 2021 (7 pages).
Third Chinese Office Action on CN Patent Application No. 201910763481.4 dated Aug. 10, 2021 (9 pages).

* cited by examiner

APRON FRONT SINK WITH INTERCHANGEABLE FACES

CROSS-REFERENCE TO RELATED PATENT APPLICATIONS

This application claims priority to and the benefit of U.S. Provisional Patent Application No. 62/720,568, filed Aug. 21, 2018. The entire disclosure of the aforementioned application is incorporated herein by reference.

BACKGROUND

The present disclosure relates generally to the field of sinks. More specifically, the present disclosure relates to a sink assembly having an apron front, which is configured to receive an interchangeable panel assembly within an opening in the front of the apron.

SUMMARY

At least one embodiment of this application relates to a sink assembly that includes a basin, an apron having an opening in a front surface, and a panel assembly that is removably received within the opening. The outer perimeter of the panel can be spaced apart from the inner perimeter of the opening of the apron, such that the panel appears to be floating within the opening. The apron can be made of or include a first material and at least one part of the panel assembly, such as the aesthetic panel, can be made of or include a second material that is different than the first material. The aesthetic panel can also be removed and replaced with another panel that has a different aesthetic and/or includes a third material that is different than the second material.

At least one embodiment relates to a sink having an apron front. The apron front has an opening that receives a panel that is coupled to a carrier. The carrier can include one or more vertically extending bores, where each bore receives a fastener. The fastener may extend upward from below the apron and through a throughgoing bore of the apron and receivably couple to the bores of the carrier. In this way, the vertically extending fasteners couple the panel assembly within the apron front. In addition, the panel assembly is configured such that a different panel can be affixed to the existing carrier and installed within the apron, so as to change the aesthetic look of the sink.

At least one embodiment relates to a sink having a basin configured to hold water; an apron extending from a front of the basin and having a plurality of walls and a rear surface defining an opening in a front of the apron; and a panel assembly removably received in the opening. An outer perimeter of the panel assembly is spaced apart from an inner perimeter of the plurality of walls of the apron.

At least one embodiment relates to a sink having a basin configured to hold water; an apron extending from a front of the basin and having a plurality of walls and a rear surface defining an opening in a front of the apron; and a panel assembly removably received in the opening. The panel assembly includes a carrier, a tray and a panel. The carrier detachably couples to the apron with a first fastener. The tray has a base and a lip that extends around a perimeter of the base, the base having a hole for receiving a second fastener, which couples the tray to the carrier. The panel couple to the base opposite the carrier and is surrounded by the lip of the tray. The tray is received in the opening in the front of the apron with a front surface of the panel facing away from the carrier.

DETAILED DESCRIPTION

Prior to turning to the figures, which illustrate the one or more exemplary embodiments in detail, it should be understood that the present disclosure is not limited to the details or methodology set forth in the description or illustrated in the figures. It should also be understood that the terminology used herein is for the purpose of description only and should not be regarded as limiting.

Referring generally to the FIGURES, disclosed herein are an apron front sink assemblies having interchangeable (e.g., removable) panel assemblies. The sink assemblies are installable into various environments including, but not limited to kitchens or bathrooms. Each receives the interchangeable panel assembly within an opening in a front of the apron of the sink. The panel assembly beneficially provides a user with the flexibility to customize the aesthetic of the sink, such as to match the aesthetic of a kitchen environment, by interchanging (e.g., replacing, substituting, etc.) panel assemblies without the need for installing an entire new sink assembly each time. Thus, a user can give their kitchen and/or sink area a "make-over" at a fraction of the cost of replacing the entire sink by replacing only an aesthetic panel of the sink.

Figure 1:
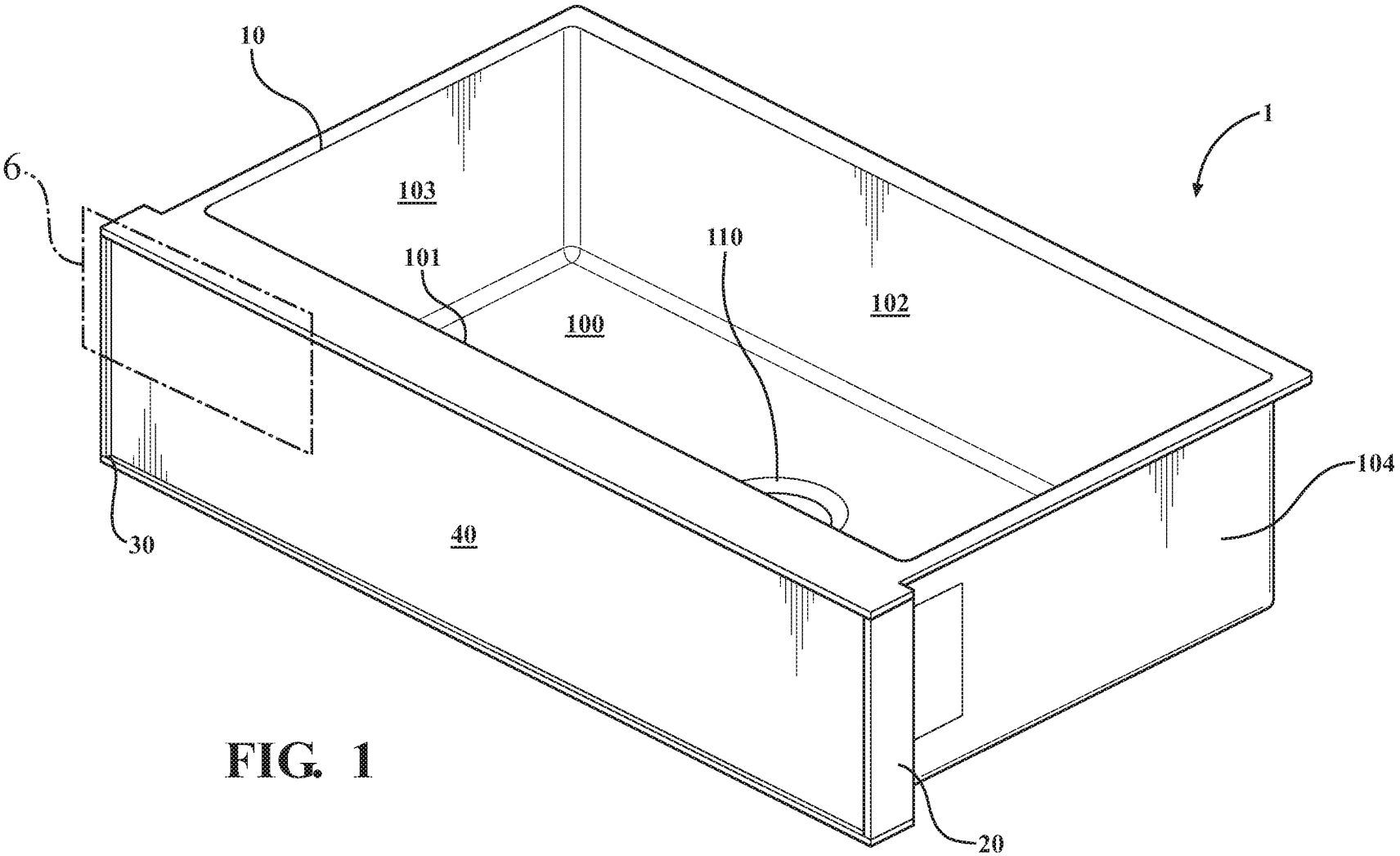
FIG. 1 is a perspective view of the sink assembly, according to an exemplary embodiment of this disclosure.

FIG. 1 illustrates a perspective view of a sink 1, according to an exemplary embodiment of this application. The sink 1 includes at least one sink basin 10 having one or more walls that together receive and hold water. Although, the illustrated basin 10 is substantially rectangular with a lateral width dimension (i.e., side-to-side) being greater than the depth dimension (i.e., front-to-back), the basin 10 can have any suitable shape or configuration. Each basin 10 includes a floor 100, which defines a drain hole 110 that allows water to exit the basin 10. The drain hole 110 is configured to couple to a drain pipe and/or garbage disposal assembly. The illustrated basin 10 includes a front wall 101, a rear wall 102, a left side wall 103, and a right side wall 104. The front wall 101 and the rear wall 102 extend laterally across the basin 10, and the left side wall 103 and right side wall 104 extend front-to-back between the front wall 101 and the rear wall 102. As shown, the walls extend generally vertical and couple to the floor 100 at substantially angled corners. In addition, the illustrated walls couple to each other at substantially right angles. The basin 10 includes a planar rim 105 around a top perimeter of at least the rear wall 102, left side wall 103, and right side wall 104. The rim 105 may extend outward from the walls 102, 103, 104, and include an upper surface 106 and a lower surface (not shown). The rim 105 may help couple the sink 1 to a countertop 202. Notably, the illustrated sink 1 is only exemplary and is not limiting. For example, the walls can extend at angles to form a generally pyramidal shaped basin, the sink can include 2 or more basins, etc.

Figure 4:
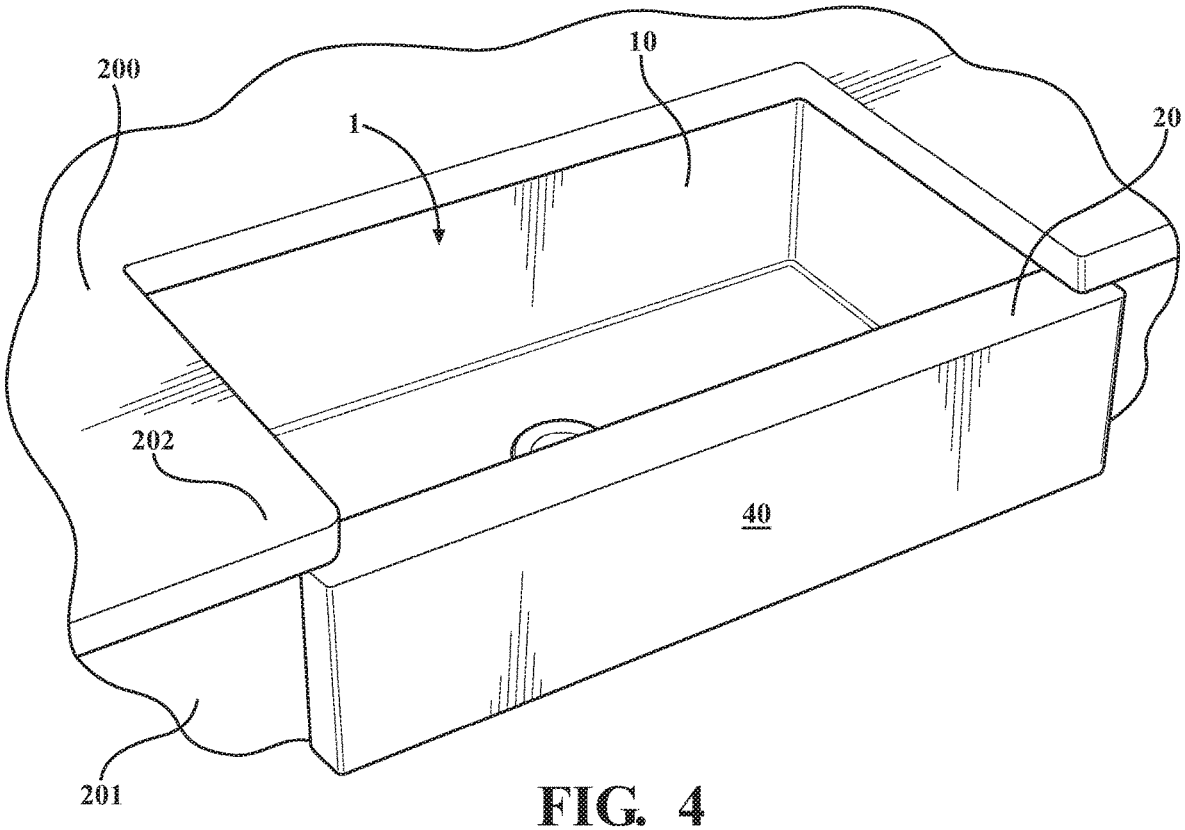
FIG. 4 is a perspective view of the sink assembly of FIG. 1 installed in a cabinet, where the sink assembly is installed in an "under-mount" configuration.
Figure 5:
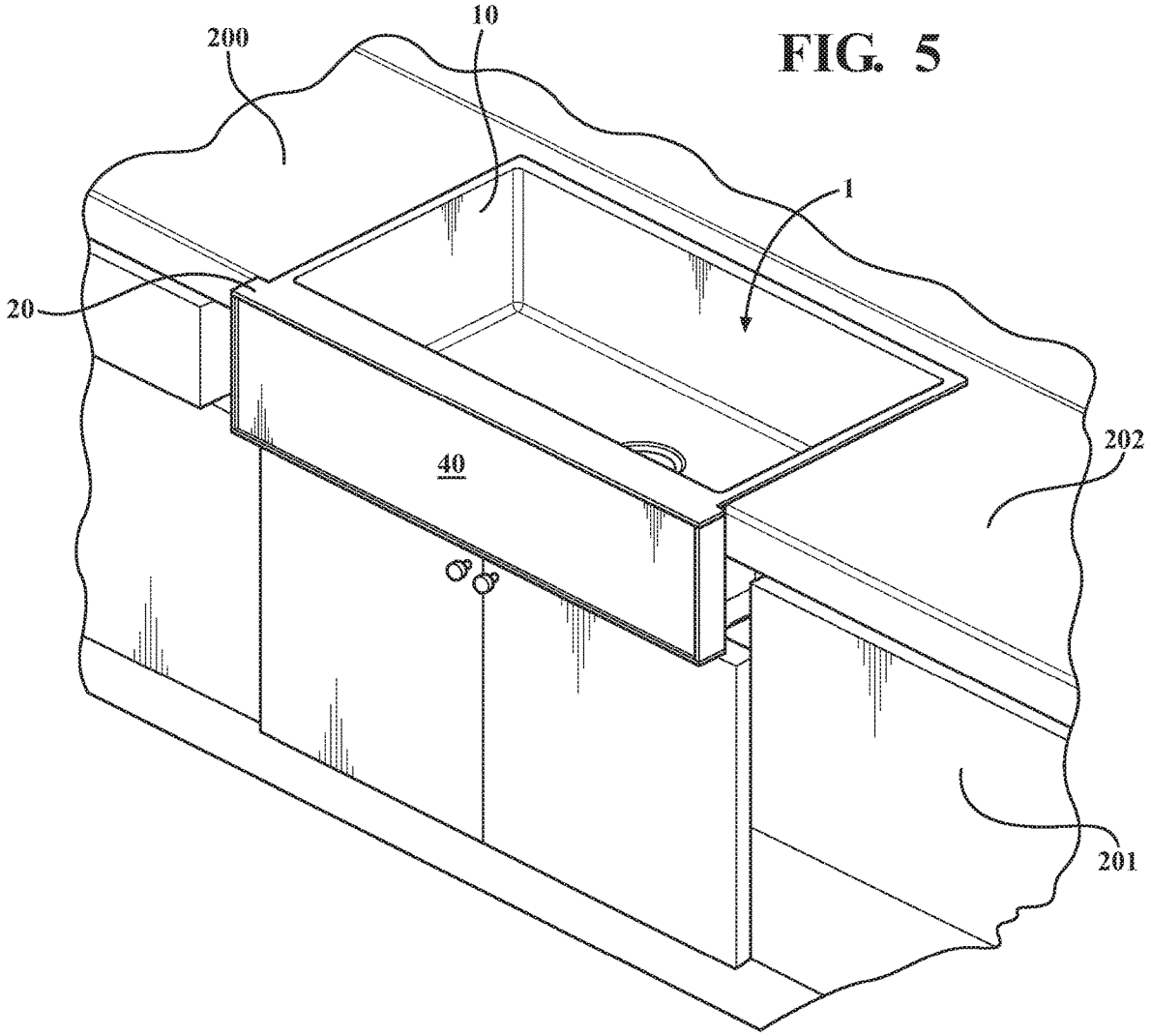
FIG. 5 is a perspective view of the sink assembly of FIG. 1 installed in a cabinet, where the sink assembly is installed in a "top-mount" configuration.

As shown, the sink 1 includes an apron 20 extending from the front of the sink 1, such as forward from the front wall 101 and down from the rim 105. The illustrated apron 20 has a generally vertical orientation and a generally rectangular cross section, although the apron can have other suitable shapes. The apron 20 is shown to extend laterally beyond the width (e.g., an outside edge) of the basin 10, and the apron 20 is configured to overlap with a portion of a front surface 201 of a cabinet 200 when the sink 1 is installed with the cabinet 200 (FIGS. 4-5). The apron 20 includes an opening 30 that detachably (e.g., removably, etc.) receives a panel assembly 2 having an interchangeable panel. By way of example, the basin 10 and the apron 20 may be made of or include a metal or alloy, such as sheet material or cast, a vitreous, or any other suitable material. The panel of the panel assembly 2 can be include any material, such as a metal or alloy (e.g., steel, brass, chrome, tin, copper, etc.), a natural or synthetic stone (e.g., granite or other igneous rocks, marble or other metamorphic rocks, sandstone or other sedimentary rocks, etc.), other naturally occurring or synthetic materials, or any combination thereof.

Figure 2:
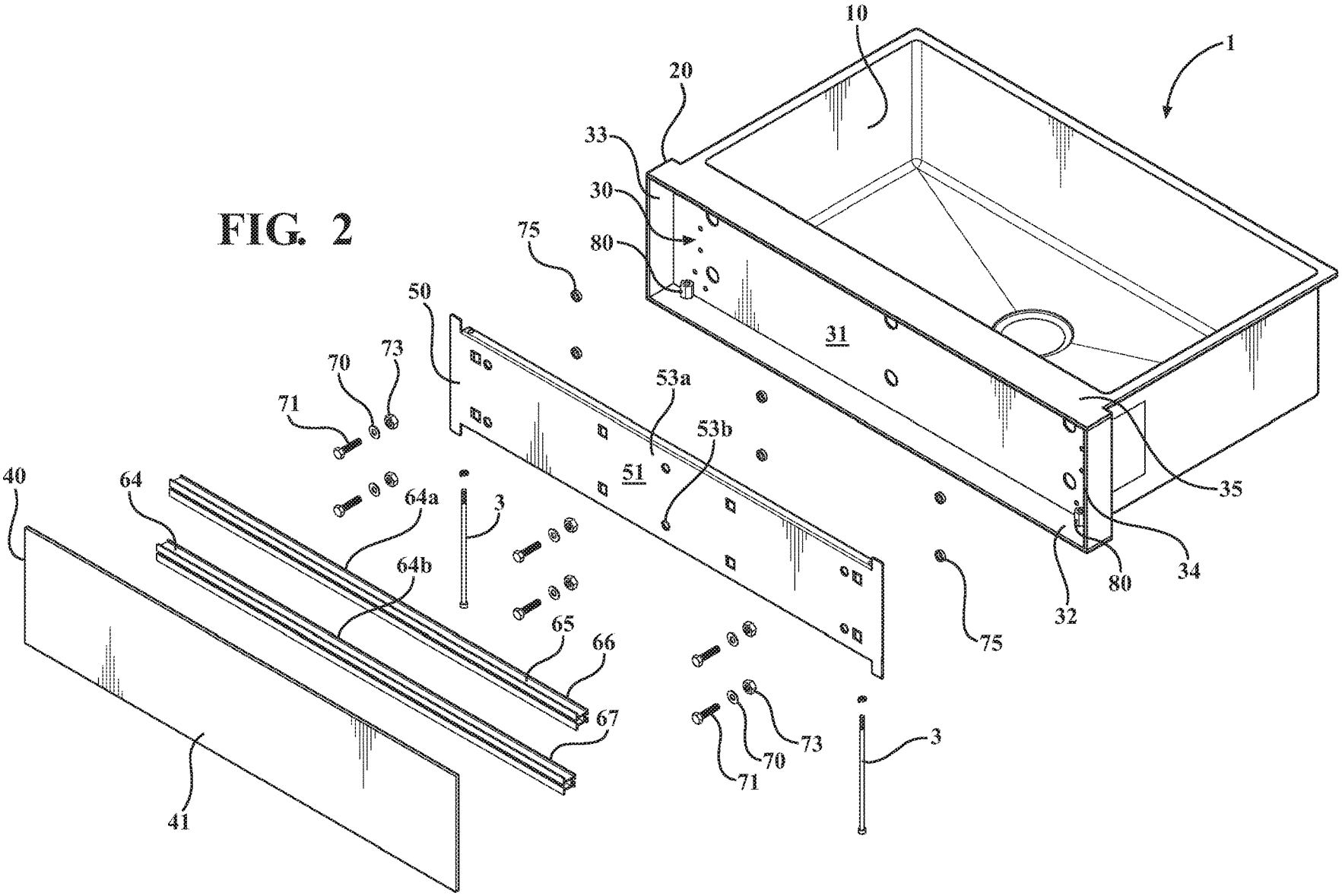
FIG. 2 is an exploded view of the sink assembly shown in FIG. 1, where the panel attaches to the carrier by way of mount rails.
Figure 10:
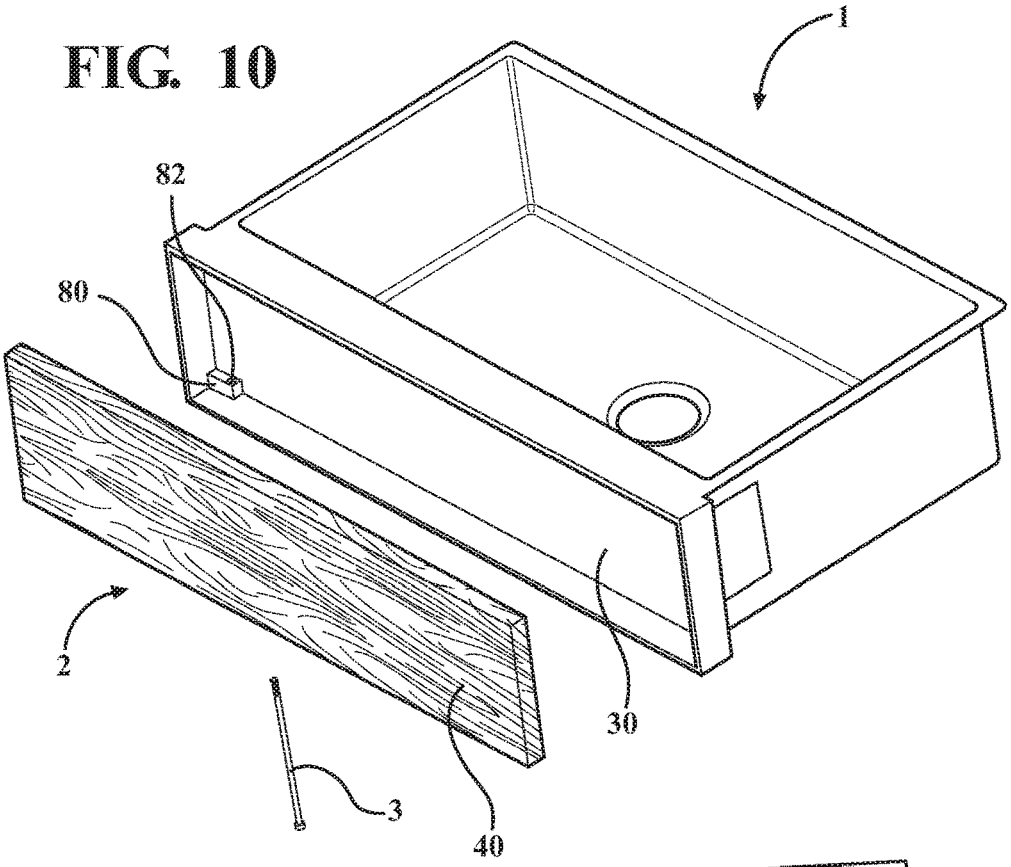
FIG. 10 is a front perspective view of an exemplary embodiment of a sink assembly shown partially assembled and having a curated stone panel.

FIG. 2 illustrates an exploded view of the components of the sink 1 shown in FIG. 1. The illustrated opening 30 in the apron 20 is defined by a rear surface 31, a bottom wall 32, a left side wall 33, a right side wall 34, and an upper wall 35. Each wall extends forward from the rear surface 31 to define the opening as a pocket for receiving the panel assembly 2 therein. The sink 1 can include one or more shoulders that help secure the panel assembly 2 in place in the pocket. As shown, a pair of lower shoulders 80 extends upwardly from the bottom wall 32 proximate opposite bottom corners of the opening 30. Each illustrated lower shoulder 80 has a substantially cylindrical cross section, although each lower shoulder 80 may have any suitable shape or position along the bottom wall 32. For example, each lower shoulder 80 can have a rectangular cross section or cuboidal shape, as shown in FIG. 10, and can extend from the rear surface 31 and/or each bottom corner of the opening 30, such that one lower shoulder 80 extends from the bottom wall 32 and each side wall 33, 34. The sink 1 can optionally include one or more upper shoulders. For example, the sink 1 can include a pair of upper shoulders 81 (see FIG. 13), configured the same as or similar to the lower shoulders 80, but extending downwardly from the upper wall 35 proximate to or in opposite upper corners of the opening 30. As shown in FIG. 10, each lower shoulder 80 includes at least one vertically extending throughgoing bore 82, which extends downward from a top surface of the shoulder 80 through the bottom wall 32 and receives a fastener 3 to secure (e.g., fixedly couple) the panel assembly 2 to the apron 20. This arrangement advantageously allows the panel assembly 2 to be secured in place by driving the fastener 3 from below (e.g., outside) the sink without negatively impacting the aesthetics since the bore 82 is only visible from underneath the apron 20. Each upper shoulder 81 includes at least one vertically extending bore (not shown), which extends upward from a lower surface of the upper shoulders 81 without passing through a top surface of the upper wall 35. Each bore 82, 83 can optionally include threads that thread to the fastener 3. In other embodiments, each shoulder 80, 81 can extend the full width of the rear surface 31, or the sink can include more than two shoulders 80, 81. For example, the shoulders 81, 82 can be a unitary element that extends between the upper and bottom walls 35, 32, and each bore can extend through the unitary element. Similarly, the shoulders 80, 81 may receive any number of fasteners 3. As shown in FIG. 2, the sink 1 includes two fasteners 3, with one fastener 3 extending through each set of shoulders 80, 81.

Also shown in FIG. 2, the panel assembly 2 includes a panel 40, a carrier 50, and a pair of laterally extending mount rails 64. An aesthetic (e.g., front) surface 41 of the panel 40 is visible to a user when the panel assembly 2 is installed into the opening 30 in the apron 20 of the sink 1. The panel 40 can be made of or include, for example, a stone, a metal, a wood, a glass, a ceramic, any combination thereof, or any other suitable unitary or composite material, which can be replaced or interchanged to tailor the aesthetics of the front surface 41 without having to replace the basin 10 of the sink 1. The front surface 41 of the panel 40 (or a portion thereof) can be coated with a water resistant material to advantageously improve durability and ease of clean-up of the panel 40 in the event water or other liquids splash onto the panel 40. The panel 40 can have one or more decorative patterns to provide a different aesthetic appearance. The panel 40 and the apron 20 can be made of or include different materials. The mount rails 64 can be made of, for example, aluminum, or any other suitable material. The carrier 50 may be made of, for example, a metal sheet material or other similar material. The panel 40 has a shape that complements the opening 30 and/or the apron 20. The illustrated panel 40 has a rectangular shape and extends laterally within the opening 30 of the apron front 20, as will be described in further detail below. A back surface 42 of the panel 40 (see FIG. 11) may face and/or couple to a front surface 65 of the mount rails 64. For example, the panel 40 couples to the mount rails 64 by way of an adhesive (e.g., double-sided adhesive strip), mechanical fasteners or other suitable coupling means.

The illustrated mount rails 64 extend laterally between the panel 40 and the carrier 50. The mount rails 64 can be disposed parallel to one another, such that an upper mount rail 64*a* may be disposed at a first height behind the panel 40, and a lower mount rail 64*b* may be disposed at a second height behind the panel 40, where the second height is lower than the first height. The mount rails 64 are shown to include a planar front surface 65, which abuts and adheres to the back surface 42 of the panel 40. The mount rails 64 are shown to further include a pair of rear flanges 66, which protrude rearward. The rear flanges 66 are shown to extend generally parallel from one another, and are separated by a channel 67, which may extend up to the length of the mount rails 64. The channel 67 may include a series of apertures, each of which being configured to receive a fastener 71. In this way, the channel 67 may be configured to receive one or more fasteners 71, each of which extends rearward through the mount rails 64, and couple the mount rails 64 (and consequently, the panel 40) to the carrier 50.

The illustrated carrier 50 includes a plurality of (e.g., six) throughgoing bores 53. The bores 53 can be disposed in a grid like pattern, such that a first series of three bores 53*a* are disposed at a first height on the carrier 50, and a second series of three bores 53*b* are disposed at a second height that is different than the first height. For example, the first series of bores 53*a* may align with the upper mount rail 64*a* when installed, while the second series of bores 53*b* may align with the lower mount rail 64*b* when installed. However, it should be appreciated that any number of bores 53 may be used, and although the bores 53 are shown in a grid like pattern to provide a sturdy coupling, the bores 53 can be arranged having a different pattern. Accordingly, the mount rails 64 may also be disposed in a different configuration than shown.

Further, the panel assembly 2 shown in FIG. 2 includes six nuts 73, six fasteners 71, six washers 70, and six pads 75. The fasteners 71 install into the apertures in the channel 67 of the mount rails 64 such that each fastener 71 extends rearward beyond the rear flanges 66 of the mount rails 64. The carrier 50 couples to the mount rails 64 such that each fastener 71 extends rearward from the mount rail 64 to be received within one associated bore 53 of the carrier 50. In this way, the carrier 50 installs such that a front surface 51 of the carrier 50 faces a back surface of the mount rails 64. A washer 70 can be coupled to each fastener 71 such that the washer 70 abuts a back surface 52 of the carrier 50. A nut 73 can be installed on each fastener 71 and may be tightened down against the washers 70, in order to secure the panel assembly 2. An adhesive can be applied to the front surface 65 of the mount rails 64, and the front surface 65 of the mount rails 64 may be coupled to the back surface 42 of the panel 40. In this way, the panel 40 couples to the carrier 50 by way of the mount rails 64.

Optionally, a series of pads 75 can be coupled to the rear surface 31 of the opening 30 of the apron 20. As shown, the panel assembly 2 includes six pads 75, which may have an adhesive or other similar coupling means on a back surface, such that the pads 75 can adhere to the rear surface 31 at heights, which correspond with the heights at which the fasteners 71, washers 70, and nuts 73 are disposed. The fasteners 71 may abut the pads 75. The pads 75 may be made of, for example, rubber, felt, or any other suitable material. The pads 75 may be designed to provide a means of sound isolation when the carrier 50 is installed (e.g., to prevent rattling), and may also operate as a buffer between the panel assembly 2 and the sink basin 10.

Figure 3:
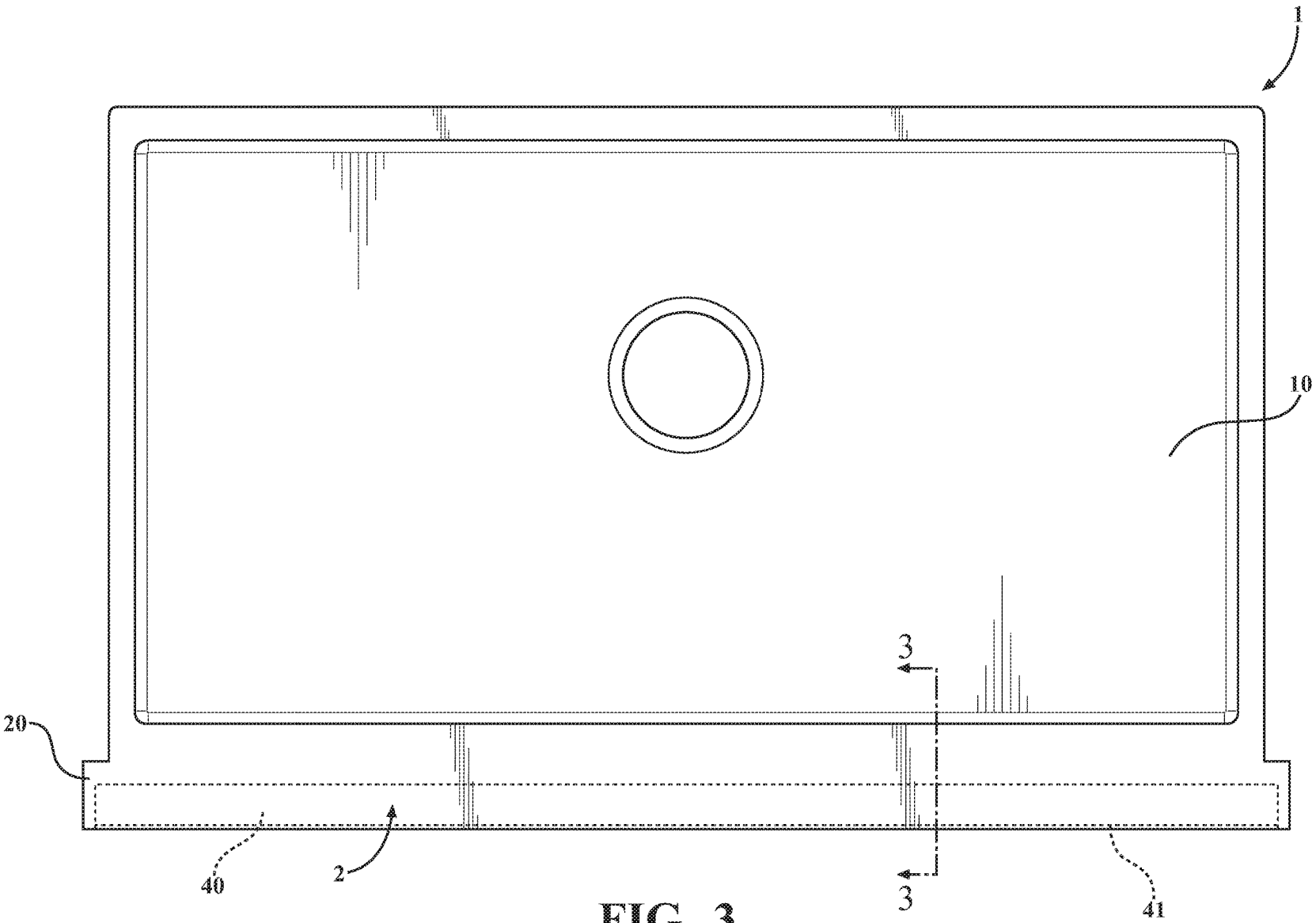
FIG. 3 is a top planar view of the sink assembly shown in FIG. 1.

FIG. 3 illustrates a top view of the sink 1. The sink 1 is configured to be installed into a cabinet 200, such that the basin 10 can be received within a countertop 202, and the apron 20 of the sink 1 can extend in front of the cabinet 200 (FIGS. 4-5). As shown in FIG. 3, the apron 20 is wider than the basin 10, which may beneficially allow for any potential seams and mounting lines to be hidden from view when the sink 1 is installed. In addition, the panel assembly 2 is shown to be received within the opening 30 such that the front surface 41 of the panel 40 is recessed in a rearward direction by a distance (e.g., ¼"-1/16") from the front surface of the apron 20.

FIGS. 4 and 5 illustrate the sink 1 installed into a cabinet 200 as an under-mount (e.g., under mount) sink (FIG. 4) and as a top-mount (e.g., top mount) sink (FIG. 5). When installed in the under mount configuration shown in FIG. 4, the upper surface 106 (FIG. 1) of the rim 105 of the basin 10 abuts and couples to a lower surface of the countertop 202. Thus, the sink 1 is installed with the rim 105 of the basin 10 below or underneath the countertop 202. The rim 105 of the basin 10 may, optionally, be mounted to the lower or bottom surface of the countertop 202 by way of fasteners, adhesive, etc. When installed in the top mount configuration, as shown in FIG. 5, the lower surface of the rim 105 of the basin 10 abuts and couples to (e.g., rests on top of) an upper or top surface of the countertop 202. In this way, the rim 105 of the basin 10 rests on and is at least partially supported by part (e.g., edges) of the top surface of the countertop 202, allowing the basin 10 to be suspended within the countertop 202.

Figure 8:
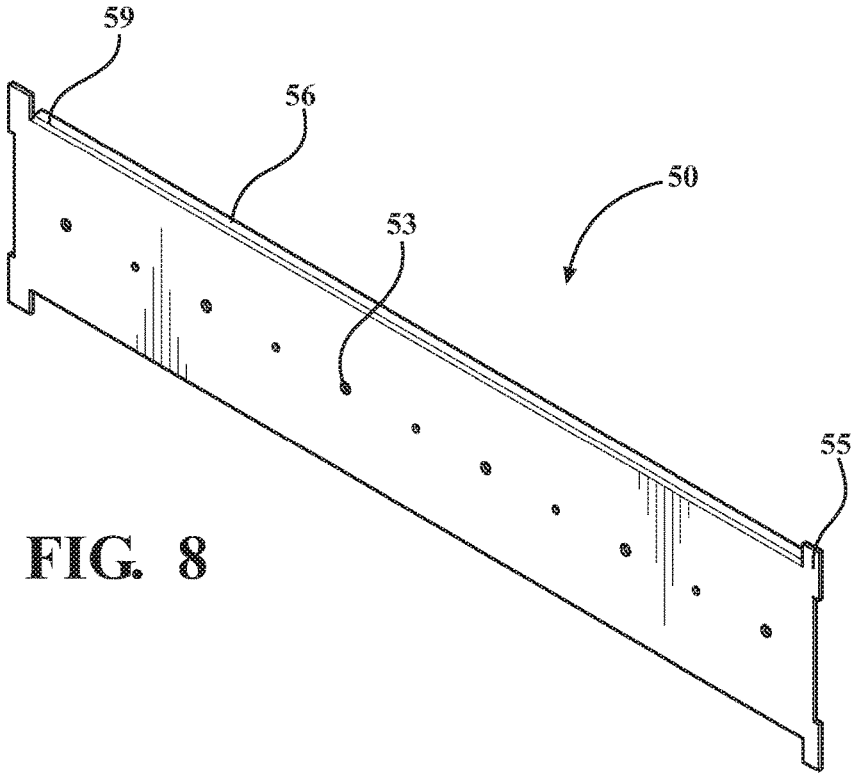
FIG. 8 is a perspective view of an exemplary embodiment of a carrier for use with a sink assembly, such as the sink assembly shown in FIG. 1.
Figure 9:
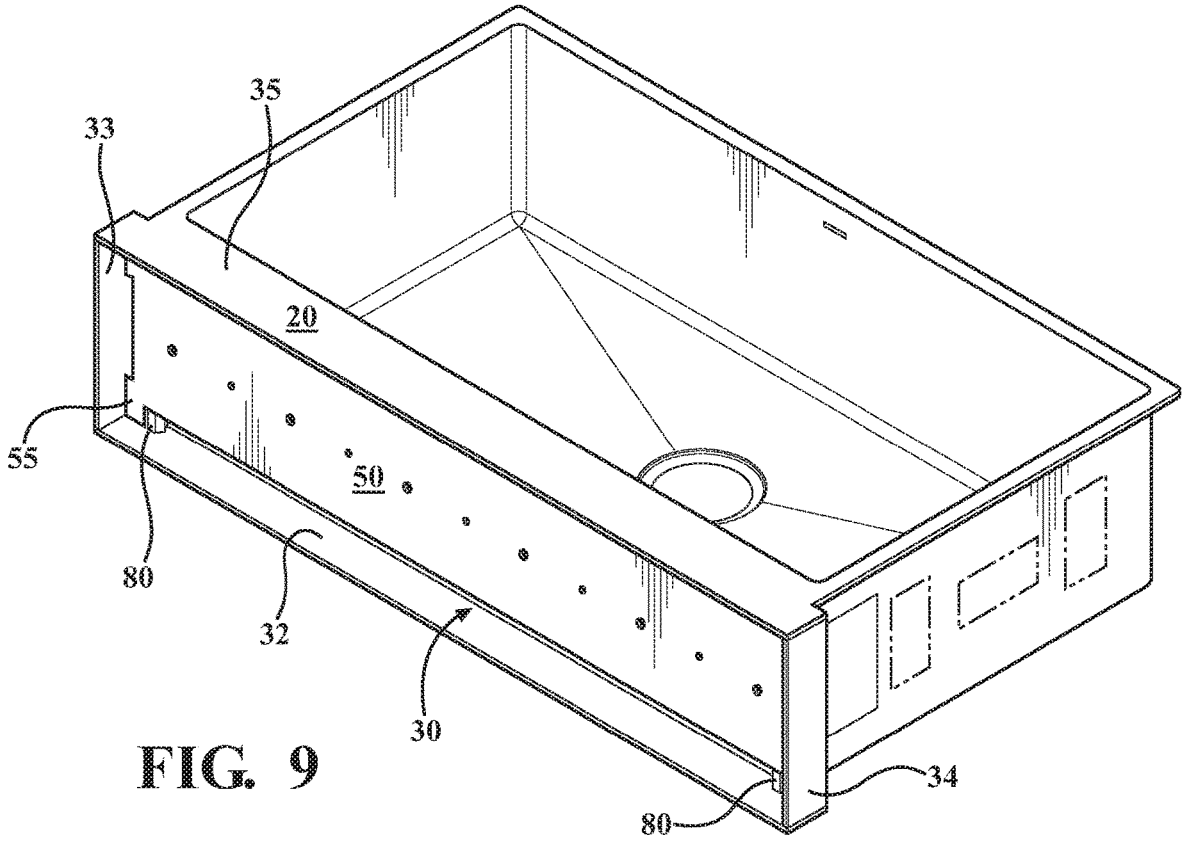
FIG. 9 is a perspective view of the sink assembly of FIG. 1 having the carrier shown in FIG. 8 installed within the opening of the apron and omitting the panel for clarity.

FIGS. 8 and 9 show the carrier 50 in better detail. Specifically, the illustrated carrier 50 includes a vertically extending support protrusion 55 extending from each corner of the four corners of the carrier 50. Each support protrusion 55, as shown, is substantially planar with the main body of the carrier 50 and has a generally rectangular shape oriented in a vertical direction. The body of the carrier 50 may have the same general size (i.e., height and width dimensions) as the panel 40, or the same width dimensions as the mount rails 64. A distance between the outer edges of the support protrusions 55 has, at most, the same height and width as the opening 30 of the apron 20. Specifically, the carrier 50 is sized in such a way that, when installed, the support protrusions 55 may abut an inner perimeter of the opening 30 to support the carrier 50 and in effect, the panel assembly 2. In other embodiments, the support protrusions 55 are sized to have approximately the same height as the panel 40, such that there is less clearance between the panel 40 and the opening 30.

Figure 11:
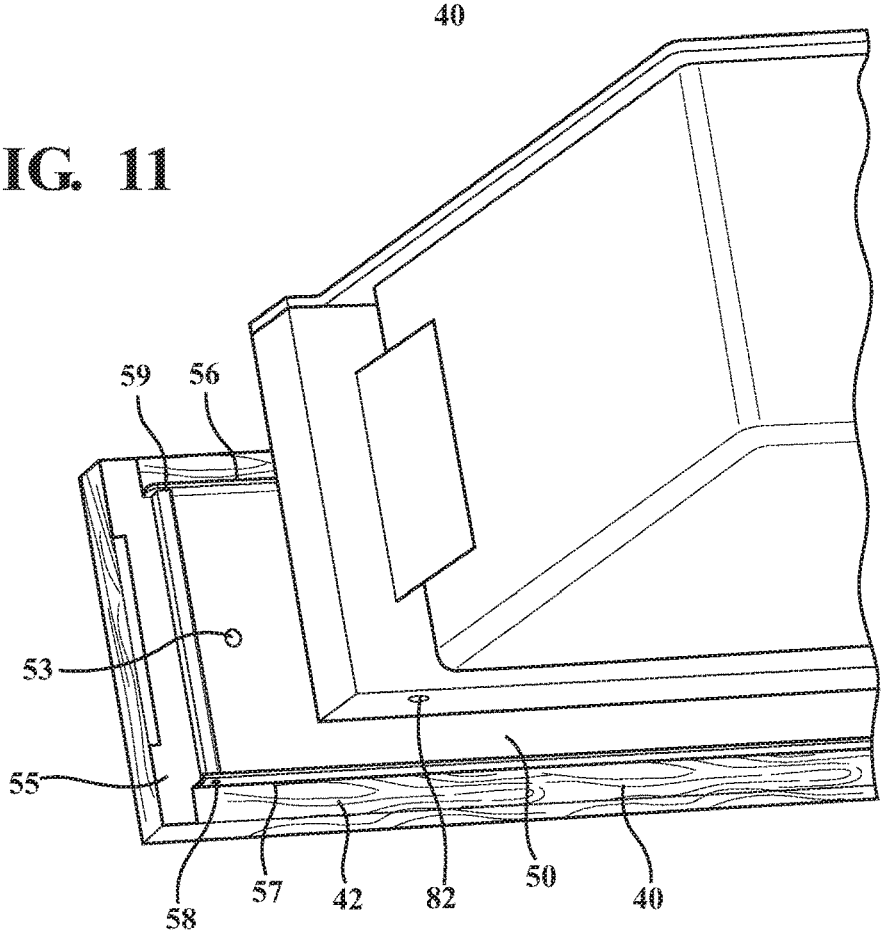
FIG. 11 is a rear perspective view of the sink assembly shown in FIG. 10.

FIGS. 9 and 11 show the carrier 50 includes a base (having the front surface 51) and an upper flange 56 and a lower flange 57 extending from a top and a bottom, respectively, of a back surface 52 of the base of the carrier 50. However, it should be appreciated that the flanges 56, 57 could be one integrally formed unit (e.g., such that it is a vertically extending flange with a cavity having a throughgoing bore). Each of the upper and lower flanges 56, 57 includes at least one vertically extending throughgoing bore 58, 59, respectively. The illustrated bores 58, 59 are configured such that each bore 58 on the lower flange 57 is concentrically aligned in a vertical direction with one associated bore 59 on the upper flange 56. In addition, the bores 58, 59, may each concentrically align with the bore 82 of the lower shoulder 80 of the opening 30 and bore 83 of the upper shoulder 81 of the opening 30. The bores 58, 59, 82, 83 are sized to receive a fastener (e.g., the fastener 3). This allows, during installation, to insert each fastener 3 upwardly from below the apron 20, through bores 82 of the shoulder 80, through the bores 58, 59 of the carrier 50 and terminate in the bore 82 of the upper shoulder 81. In other words, upwardly extending fasteners 3 are insertable from below the apron 20 to fixedly couple the panel assembly 2 to the apron 20. In addition, the flanges 56, 57 and carrier 50 can be configured such that when the panel assembly 2 is installed in the opening 30, a back surface of the support protrusions 55 abut a front surface of the lower shoulders 80 and upper shoulders 81.

Figure 6:
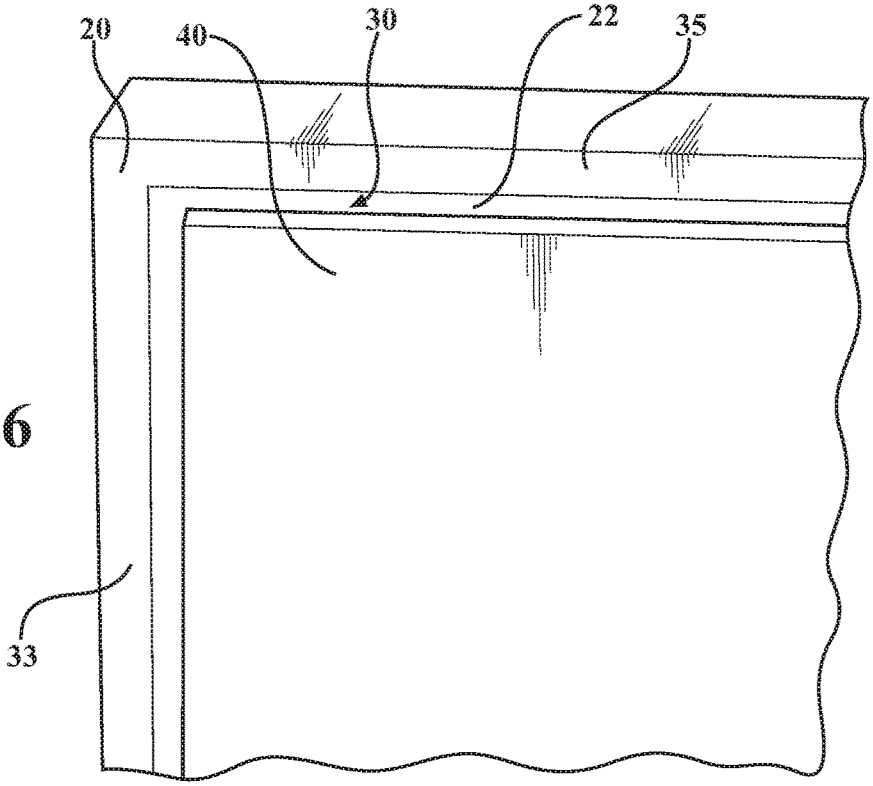
FIG. 6 is a detail view of the portion of the sink assembly shown in View 6 of FIG. 1.
Figure 7:
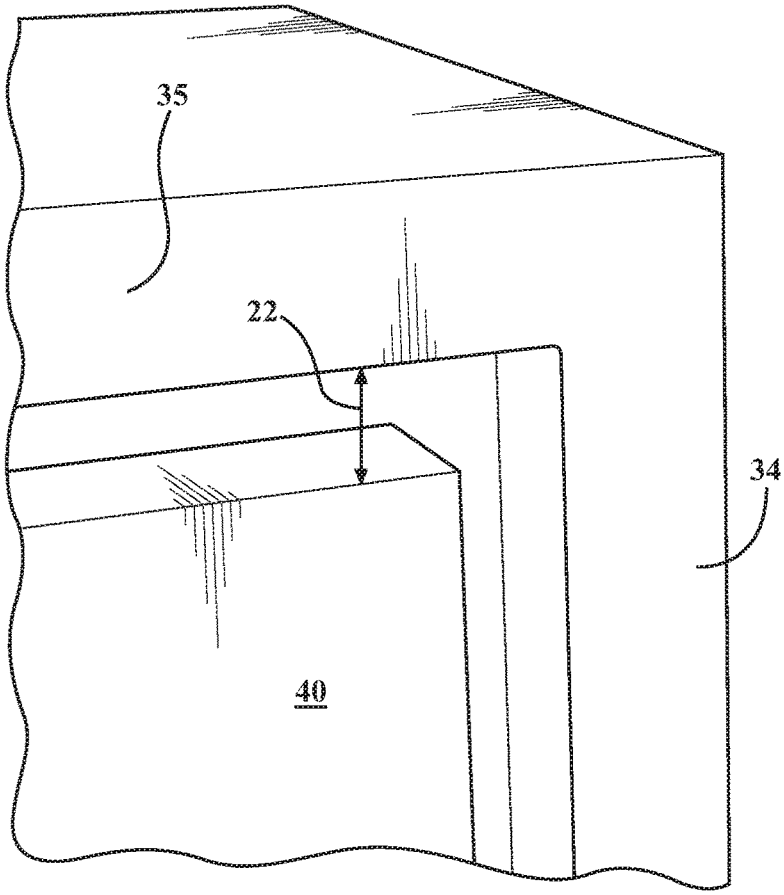
FIG. 7 is a perspective view of a portion of the sink assembly shown in FIG. 1 illustrating the spacing between the panel and the apron in greater detail.

FIGS. 6 and 7 show, as described elsewhere, that the panel assembly 2 is designed having an outer perimeter of the panel 40 separated from or spaced apart from an inner perimeter of the apron 20 defining the opening 30 (e.g., the walls 32, 33, 34, 35) by a predetermined gap 22. The gap can be on one, two, three, or all sides (e.g., four sides) of the apron 20. The arrangement of the sink 1 and the panel assembly 2 allow for the gap 22 to be tailored, such that if after an initial assembly, one side of the gap varies from one or more sides, then the installer/homeowner can adjust the panel assembly 2 to have a common gap. The gap 22 is further advantageous because it allows for expansion/contraction of the panel assembly 2 and the sink 1 relative to one another. For example, the material(s) forming the panel assembly 2 (e.g., the panel 40) can be different from the material(s) forming the apron 20. The material differences may lead to different relative expansion/contraction of the parts. The gap 22 accommodates the different relative expansion/contraction of the parts. The illustrated sink 1 has the same gap 22 each side of the panel 40 and the associated (e.g., offset) wall of the apron 20. As can be seen, the panel 40 appears to be floating or suspended within the opening 30 of the apron 20. In addition to the aesthetic appeal of such a feature, it also provides the ability to accept greater manufacturing variability or clearance of the panel assembly 2 components (e.g., the panel 40).

Also shown in FIGS. 4 and 5, the design of the sink 1 allows for the panel assembly 2 to appear to float within the apron 20, and also beneficially has all fasteners hidden from view (e.g., when standing in front of the sink). However, while the fasteners 3 may be hidden (i.e., only an end of the fasteners 3 extend below the apron 20), the fasteners 3 beneficially remain easily accessible in the event that the user wants to change the current panel assembly 2 for a different one to change the aesthetic of the sink 1. Specifically, the configuration of the sink 1 and the positioning of the apron 20 allow a user to simply remove the (two) fasteners 3 and pull the panel assembly 2 out to exchange the panel 40 and/or the entire panel assembly 2. Then the modified panel assembly 2 can be reinstalled into the opening 30 of the apron 20 and the fasteners 3 tightened to secure the panel assembly 2 in place.

In terms of installation, the sink basin 10 is configured to be installed into a notched area of the countertop 202 of a cabinet 200 (e.g., as shown in FIGS. 4 and 5). The panel assembly 2 can be pre-assembled or assembled by the installer/homeowner prior to coupling to the sink 1. The panel assembly 2 shown in FIG. 2 includes the panel 40, the carrier 50, a pair of lateral mount rails 64, a plurality of nuts 73, a plurality of fasteners 71 (i.e., studs), a plurality of washers 70, and a plurality of pads 75. Specifically, the illustrated panel assembly 2 includes six nuts 73, six fasteners 71, six washers 70, and six pads 75. However, the panel assembly 2 can include a fewer or greater number of parts. By way of example, the panel assembly 2 can include a fewer number of fasteners, washers, pads, etc. and/or include only a single rail or additional rails. The carrier 50 includes one throughgoing bore 53 that receives one associated set of fasteners (e.g., fastener 71, washer 70, etc.) therethrough. The carrier 50 can include a fewer or greater number of bores 53, as shown, to accommodate an increase/decrease in the number of fasteners.

FIGS. 10 and 11 show a panel assembly 2 having a panel 40, which includes a curated stone. Like the embodiment shown in FIG. 2, the embodiment shown in FIG. 11 includes one or more lateral mount rails 64 (two rails 64 are shown), each rail 64 having a planar front surface 65 that abuts and/or adheres to the back surface 42 of the panel 40, as shown in FIG. 11. Each mount rail 64 further includes one or more rearward protruding (rear) flanges 66. Where the rail 64 has two or more flanges, each adjacent pair of flanges are separated by a channel 67 (see FIG. 2). The flange and/or channel includes one or more throughgoing apertures, each of which receives one fastener (e.g., fastener 71) to secure the panel to the apron. For example, one fastener 71 can be inserted through each aperture and into the channel 67 of each lateral rail 64 from the front surface 65, such that the fastener 71 extends rearward and into an associated aligning bore 53 of the carrier 50. Optionally, one or more washers 70 can be used with each fastener 71, such that the washers 70 are proximate (e.g., abut) the back surface 52 of the carrier 50 upon assembly. A nut 73 can be threaded to each fastener 71 and located proximate to (e.g., abutting) a back surface of one associated washer 70 to clamp the washer 70 against the carrier 50 to secure the panel assembly 2 together. Optionally, the front surface 65 of each mount rail 64 can have an adhesive that couples the front surface 65 to the back surface 42 of the panel 40. In this way, the panel 40 couples to the carrier 50 by way of the mount rails 64 upon assembly of the panel assembly 2. Optionally, a back surface of each pad 75 can adhesively couple to the rear surface 31 of the apron 20 at various heights that correspond with the heights at which the fasteners 71, washers 70, and nuts 73 are disposed.

Next, the panel assembly 2 is installed into the opening 30 with the front surface 41 of the panel 40 is facing forward, and the back surface 52 of the carrier 50 is closest to the rear surface 31 of the opening 30. The panel assembly 2 can be positioned with the lower flange 57 of the carrier 50 being supported by the lower shoulders 80 of the apron 20 in the opening 30. The panel 40 can be positioned within the opening 30 such that the bores 82 of the lower shoulder 80 concentrically align with the bores 58 on the lower flange 57 of the carrier 50. The fasteners 3 are installed such that they upwardly extend through the bores 82 in the shoulder 80, the bores 58 of the lower flange 57, the bores 59 of the upper flange 56 if provided, and through the bores 83 of the upper shoulders 81 before terminating in the upper shoulder 81. In this way, the panel assembly 2 can be installed into the apron 20, and, due to the design of the support protrusions 55 and the shoulders 80, 81 supporting the flanges 56, 57 of the carrier 50, the panel 40 can be spaced apart from all sides of the apron 20 by a gap 22. This beneficially provides an aesthetic appeal to appear as if the panel 40 is floating or suspended within the apron 20. The use of the two fasteners 3 extending upward from below the apron 20 to hold the panel assembly 2 in place also minimizes the visible hardware while providing an easily exchangeable panel assembly 2.

A user (e.g., homeowner) may choose to exchange the panel 40 for a different panel 40 to provide a different aesthetic to the sink 1. To do this (i.e., to uninstall the panel assembly 2), the user simply removes the fasteners 3 from the bottom wall 32 of the apron 20. Once the fasteners are removed, the panel assembly 2 can be removed from the opening 30 of the apron 20. In some embodiments, a new panel 40 mounts onto an existing carrier 50 (or new carrier). Thus, the carrier 50 is reusable with some embodiments, such as with other parts (e.g., new mount rails 64, a panel 40, adhesive, a plurality of fasteners 71, a plurality of washers 70, a plurality of nuts 73, etc.). The new panel assembly 2 assembles and installs in the same manner as described above. Providing panels 40 that are interchangeable advantageously reduces cost and timing to replace the aesthetic, and is easy to replace and install using the same carrier 50 and fasteners 3.

Figure 12:
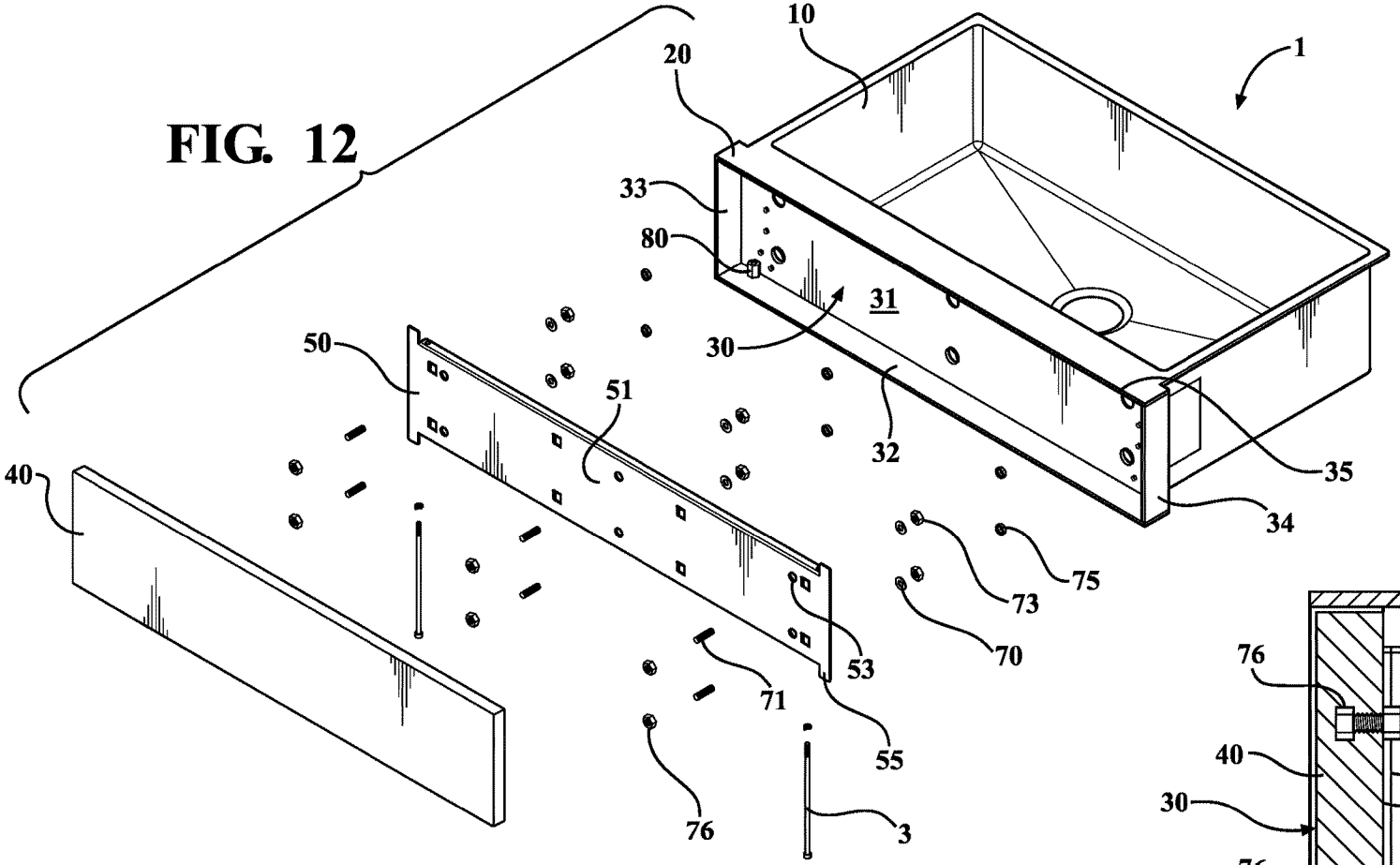
FIG. 12 is an exploded front perspective view of an exemplary embodiment of a sink assembly having the structure of the sink assembly shown in FIG. 1, but with a different curated stone panel.
Figure 13:
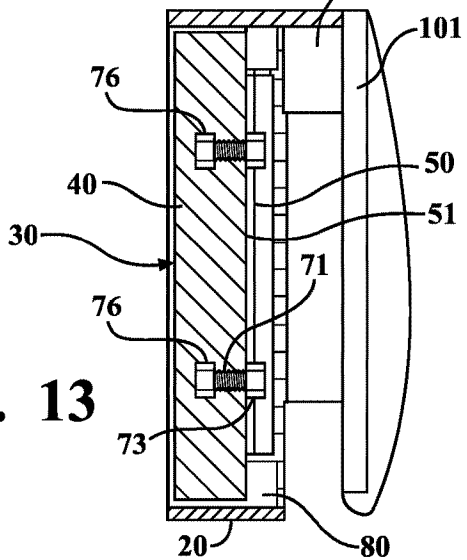
FIG. 13 is a side cross-sectional view taken along lines 3-3 of the sink assembly shown in FIG. 3 illustrating structure for use with certain embodiments, such as those shown in FIGS. 1 and 10-12.
Figure 14:
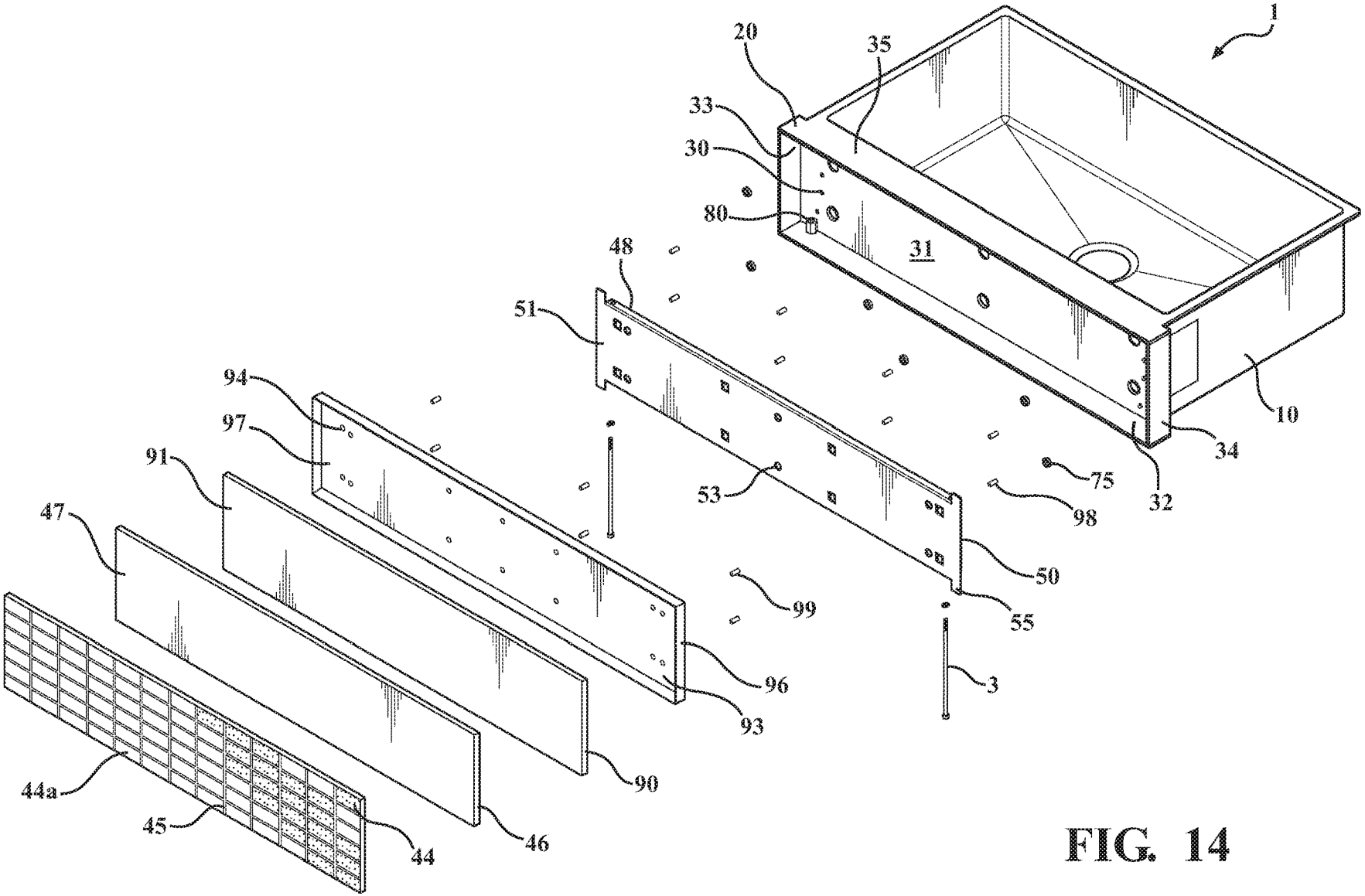
FIG. 14 is an exploded perspective view of an exemplary embodiment of a sink assembly having a tiled panel design.

FIGS. 12-14 show exemplary embodiments of panel assemblies 2 for use with the sinks of this application. FIG. 12 shows a panel 40 that is made of a stone. The embodiment shown in FIG. 12 is similar to the embodiment shown in FIG. 2, except where noted otherwise. For example, the back surface 42 of the panel 40 of FIG. 12 may include a plurality of bores, each of which receives an associated nut 76 to attach the panel 40 to the carrier 50, instead of including a pair of lateral rails 64 disposed between the panel 40 and the carrier 50, as shown in FIG. 2. Specifically, the panel assembly 2 shown in FIG. 12 includes a carrier 50 and a panel 40 having a series of six bores disposed on the back surface 42 of the panel 40. Each bore 43 receives a keep nut 76. Each keep nut 76 can couple to the associated bore 43 of the panel 40 by way of, for example, a press-fit during assembly. Each keep nut 76 receives and couples to a fastener 71 extending forward into the panel 40 to mount the panel 40 to the carrier 50. Although the panel assembly 2 shown in FIG. 12 includes six fasteners 71, six washers 70, six nuts 73, and six pads 75, a fewer or greater number of parts can couple the panel and the carrier together.

The carrier 50 shown in FIG. 12 also includes a plurality of (e.g. six) throughgoing bores 53 that, upon installation of the sink, can concentrically align with the bores 43 of the panel 40. However, it should be appreciated that any number of bores may be used. The fasteners 71 install into the keep nuts 76 (i.e., within the bores 43) on the back surface 42 of the panel 40, and extend rearward from the back surface 42 of the panel 40. The carrier 50 couples to the panel 40 with the fasteners 71, which extend from the back surface 42 of the panel 40, received within the corresponding bores 53 of the carrier 50. The carrier 50 is installable with the front surface 51 of the carrier 50 abutting the back surface 42 of the panel 40. Optionally, a washer 70 can couple to each fastener 71 with the washer 70 abutting the back surface 52 of the carrier 50. A nut 73 can thread on each fastener 71 and upon tightening down against the washer 70, secure the panel assembly 2. Optionally, one or more (e.g., six) pads 75 may have an adhesive on a back surface to adhere the pads 75 to the rear surface 31 of the apron 20 at heights corresponding with heights at which the fasteners 71, washers 70, and nuts 73 are disposed. The fasteners 71 may abut the pads 75 to provide a means of isolating sound during installation, and to act as a buffer. The installation of the panel assembly 2 of FIG. 12 into the opening 30 may be accomplished in the same manner as described above (i.e., with regard to the installation of the panel assembly 2 of FIG. 2 into the opening 30).

FIG. 13 illustrates a side cross sectional view of the sink and the panel assembly 2 shown in FIG. 12 (with the section cut in a corresponding location as lines 3-3 shown in FIG. 3), with the panel assembly 2 of FIG. 12 installed into the opening 30 in the apron 20. As shown, the opening 30 in the apron 20 receives the entire panel assembly 2 in an installed/assembled position of the sink 1. As shown, the front surface 41 of the panel 40 is flush with or recessed behind/inside of (i.e., not extend beyond) the forward-most surface of the walls of the apron 20 (i.e., the fronts of each of the left side wall 33, right side wall 34, bottom wall 32, and upper wall 35). As described above, when the panel assembly 2 is installed into the opening 30, the panel 40 may be the outermost, visible layer of the panel assembly 2, and the back surface 42 of the panel 40 may couple to a front surface 51 of the carrier 50 either directly (e.g., adhesive) and/or indirectly (e.g., one or more fasteners). If fastener(s) are employed, each fastener 71 can extend inward from the front surface 51 of the carrier 50 and can receive at least one of a washer 70 and a nut 73 to couple the entire panel assembly 2 together. It should be appreciated that a panel assembly 2, as shown in FIG. 2 (i.e., where mount rails 64 are used in addition to the panel 40 and carrier 50), may be installed into the opening 30 in substantially the same manner.

FIG. 14 illustrates an embodiment having a panel with a tile aesthetic, which may be made of one or more individual tiles. The illustrated embodiment includes a tile panel 44, a backer board 46 (e.g., cement backer board), a filler layer 90 (e.g., one or more sheets of filler wood), a tiling tray 93, a carrier 50, and a sink basin 10 having an apron 20 with an opening 30. The tile panel 44 can include any number of individual tiles **44*a* having any shape, size, color, pattern, etc. Each tile 44*a* can couple to a front surface 47 of the backer board 46 by way of, for example, grout 45. For example, the tiles 44*a* shown in FIG. 14 are rectangular tiles positioned in a grid like pattern, where each tile 44*a* couples to the front surface 47 of the backer board 46 by way of grout 45. The tiles 44*a* may come preassembled, such that they a user may purchase them already adhered to the backer board 46, or the user may mount the tiles 44*a* to the backer board 46. The grout 45 may be applied to the front surface 47 of the backer board 46 to couple the individual tiles 44*a* to the front surface 47 of the backer board 46**.

One or more sheets of filler wood can make up the filler layer 90, which can couple to a back surface 48 of the backer board 46 to provide additional thickness and durability. An adhesive or other coupling agent/device may couple a front surface 91 of the sheet of filler layer 90 and a back surface 48 of the backer board 46 to couple the backer board 46 to the filler layer 90. The backer board 46 and the filler layer 90 may have the same general size (i.e., height and width dimensions), and may be configured such that when coupled, may align with one another. The backer board 46 and the filler layer 90 may be at least partially received within and coupled to the tiling tray 93. As shown, the tray 93 receives the entireties of the backer board 46 and the filler layer 90 in a pocket defined by a base and a lip.

The illustrated tiling tray 93 has a rectangular shape and includes a raised lip 96 which extends perpendicular from a front surface 94 of a base of the tiling tray 93 (i.e., in a forward direction when installed) along the perimeter of the tiling tray 93. The raised lip 96 helps position and at least partially receive the filler layer 90 and the backer board 46. The tiling tray 93 is shown to include a series of throughgoing bores 97, which extend through the front surface 94 of the tiling tray 93. The bores 97 may be disposed in a grid like pattern, and are configured to each receive a fastener 98, which couples the tiling tray 93 to the filler layer 90. Specifically, the filler layer 90 (and thus, also the backer board 46 to which it is attached) may couple to the tiling tray 93 by positioning the filler layer 90 such that the back surface 92 of the filler layer 90 abuts the front surface 94 of the tiling tray 93. Further, the perimeter of the filler layer 90 may be disposed within the raised lip 96 of the tiling tray 93. One or more fasteners 98 couple to the filler layer 90 by inserting the fasteners 98 from a back surface 95 of the tiling tray 93, through the bores 97 of the tiling tray, such that they extend forward into the filler layer 90 to securely mount the filler layer 90 to the tiling tray 93.

In addition, the back surface 95 of the tiling tray 93 may include a plurality of protruding studs 99, which extend rearward from the tiling tray 93. FIG. 14 illustrates six protruding studs 99 as separate pieces from the tiling tray 93 to show the protruding studs 99 in greater detail. However, it should be appreciated that the protruding studs 99 may be integrally formed with the tiling tray 93, or may be coupled to the tiling tray 93 by way of, for example, welding, adhesive or some other suitable method. The protruding studs 99 may include threads, and may be disposed in a grid like pattern on the back surface 95 of the tiling tray 93.

The carrier 50 is also shown to include a plurality of throughgoing bores 53 that, when installed, may concentrically align with and receive the protruding studs 99 of the tiling tray 93. One or more of the throughgoing bores 53 may concentrically align with an associated bore 97 of the tiling tray 93, such that the fasteners 98, which mount the tiling tray 93 to the filler layer 90, may also extend through the carrier 50. Thus, the fasteners 98 may securely couple the carrier 50, the tiling tray 93, the filler layer 90, and the backer board 46. When assembled, the protruding studs 99 of the tiling tray 93 may extend rearward, through the bores 53 of the carrier 50, and extend rearward beyond the back surface 52 of the carrier 50. When assembled, the back surface 95 of the tiling tray 93 may abut the front surface 51 of the carrier 50. The six protruding studs 99 may each receive and couple to a washer 70 and/or a nut 73. Each washer 70 may abut the back surface 52 of the carrier 50. Each nut 73 threads to one protruding stud 99 and tightens down against the washer 70 to secure the tiling tray 93 to the carrier 50. The sink can employ one or more pads 75. FIG. 14 shows a plurality of six pads 75, which have an adhesive or the like on a back surface, where each pad 75 adheres to the rear surface 31 of the opening 30 at a height, which corresponds with a height of an associated protruding stud 99 (and/or washer 70 and/or nut 73). The protruding studs 99 may abut the pads 75 to provide a means of isolating sound during installation and to act as a buffer. The installation of the tile panel 44 and embodiment of FIG. 14 into the opening 30 of the apron 20 may be accomplished in the same manner as described above (i.e., with regard to the installation of the panel assembly 2 of FIG. 2 into the opening 30).

Figure 15:
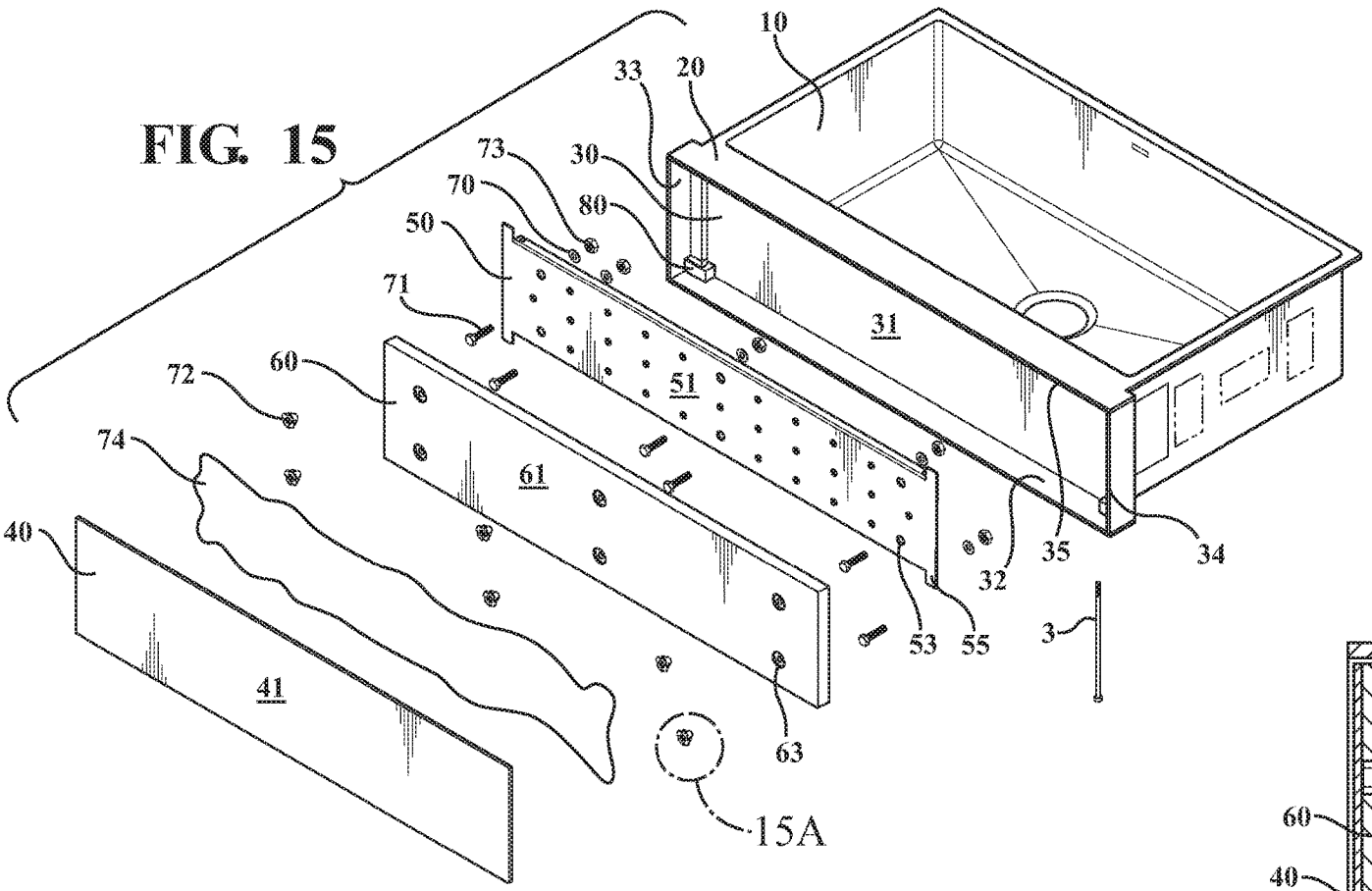
FIG. 15 is an exploded perspective view of an exemplary embodiment of a sink assembly having a panel attached to the carrier by way of a backing material instead of mount rails.

FIG. 15 illustrates another embodiment of the panel assembly 2 that includes a panel 40, a carrier 50, and a backing material 60 (i.e., the backing material 60 may be used instead of the lateral mount rails 64). The backing material 60 can include or be made of, for example, a wood (e.g., plywood), a polymer or any other suitable material. The panel 40 and the backing material 60 may each have a rectangular shape and extend laterally within the opening 30 of the apron front 20, as will be described in further detail below. A back surface 42 of the panel 40 (FIG. 11) may face and couple to a front surface 61 of the backing material 60. For example, the panel 40 can couple to the backing material 60 by way of an adhesive 74 or the like.

Figure 15A:
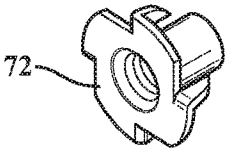
FIG. 15A is a perspective view of an insert included in the sink assembly shown in FIG. 15.

The backing material 60 shown in FIG. 15 includes six throughgoing counterbores 63 (although a fewer or greater number can be employed). As shown, the carrier 50 includes six bores 53, which, when installed, concentrically align with the counterbores 63 of the backing material 60. However, it should be appreciated that any number of bores/counterbores may be used. Although the bores 53, 63 are shown in a grid like pattern such that they may provide a sturdy coupling, the bores 53, 63 can be arranged having a different pattern. In addition, the panel assembly 2 is shown to include six nuts 73, six inserts 72 (an enlarged view of which is provided in FIG. 15A), six fasteners 71, and six washers 70. The inserts 72 are configured to be received within the counterbores 63 on the front surface 61 of the backing material 60. The inserts 72 may be press-fit into the counterbores 63 and may be, for example, threaded T-nuts. The fasteners 71 may be installed into the counterbores 63 on the front surface 61 of the backing material 60, such that they are received within the counterbores 63 and extend through the back surface 62 of the backing material 60. The carrier 50 is coupled to the backing material 60, such that the fasteners 71 extending from the back surface 62 of the backing material 60 are received within the corresponding bores 53 of the carrier 50. In this way, the carrier 50 can be installed such that the front surface 51 of the carrier 50 abuts the back surface 62 of the backing material 60. A washer 70 may be coupled to each fastener 71, such that the washer 70 abuts the back surface 52 of the carrier 50. A nut 73 may be installed on each fastener 71 and may be tightened down against the washers 70, in order to secure the panel assembly 2.

Figure 16:
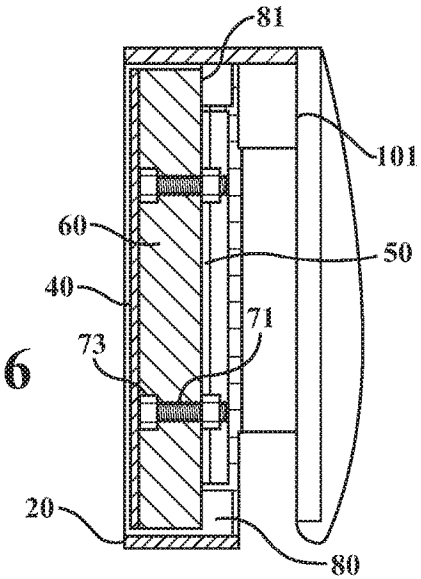
FIG. 16 is a side cross-sectional view of the sink assembly shown in FIG. 15 taken along lines 3-3 of the sink assembly shown in FIG. 3.

FIG. 16 illustrates a side cross sectional view along lines 3-3 of the panel assembly 2 installed into the opening 30 in the apron 20. As shown, when installed, the entire panel assembly 2 can be received within the opening 30 in the apron 20 of the sink 1. Thus, the front surface 41 of the panel 40 can be flush with or recessed inside of (i.e., not extend beyond) the forwardmost surface of the walls of the apron 20 (i.e., the fronts of each of the left side wall 33, right side wall 34, bottom wall 32, and upper wall 35). As described above, when the panel assembly 2 is installed into the opening 30, the panel 40 may be the outermost, visible layer of the panel assembly 2. The back surface 42 of the panel 40 may couple to a front surface 61 of the backing material 60; and the front surface 51 of the carrier 50 may couple to the back surface 62 of the backing material 60. Lastly, the fasteners 71 may extend inward from the front surface 61 of the backing material 60, through the carrier 50, and may receive a washer 70 and nut 73, which couples the entire panel assembly 2. In other embodiments, the backing material 60 may be integrally formed with the panel 40.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, and/or illustrations of possible embodiments (and such terms are not intended to connote that such embodiments are necessarily extraordinary or superlative examples).

The term "coupled," as used herein, means the joining of two members directly or indirectly to one another. Such joining may be stationary (e.g., permanent or fixed) or moveable (e.g., removable or releasable). Such joining may be achieved with the two members coupled to each other, with the two members coupled with a separate intervening member and any additional intermediate members coupled with one another, or with the two members coupled together with an intervening member that is integrally formed as a single unitary body with one of the two members. Such members may be coupled mechanically, electrically, and/or fluidly.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the shelf assembly as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, the position of elements may be reversed or otherwise varied, and the nature or number of discrete elements or positions may be altered or varied. Any element disclosed in one embodiment may be incorporated or utilized with any other embodiment disclosed herein. Although one example of an element that can be incorporated or utilized in another embodiment has been described above, it should be appreciated that other elements of the various embodiments may be incorporated or utilized with any of the other embodiments disclosed herein.

Other substitutions, modifications, changes and omissions may also be made in the design, operating conditions and arrangement of the various exemplary embodiments without departing from the scope of the present invention. For example, any element (e.g., arm, shelf member, fastener, etc.) disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

What is claimed is:

1. A sink comprising:

a basin configured to hold water;

an apron extending from a front of the basin and having an upper wall, a lower wall, a first side wall, a second side wall, and a rear surface defining an opening in a front of the apron; and a panel assembly removably received in the opening and comprising:

a carrier detachably coupled to the apron with a first fastener;

and a panel detachably coupled to the carrier, wherein a gap is formed between an outer perimeter of the panel assembly and each of the upper wall, the lower wall, the first side wall, and the second side wall of the apron.

2. The sink of claim 1, wherein the panel assembly includes a panel having at least one of an aesthetic or a material, which is different than an aesthetic or a material of the apron.

3. The sink of claim 2, wherein a front surface of the panel is flush with or recessed rearwardly from a front surface of the apron.

4. The sink of claim 1 wherein:

the carrier includes a base and at least one flange extending away from the base of the carrier toward the rear surface of the apron; and the at least one flange includes an opening for receiving a fastener.

5. The sink of claim 4, wherein:

the at least one flange includes upper and lower flanges that extend from a top and a bottom of the base, respectively;

each of the upper and lower flanges includes an opening for receiving the fastener; and the fastener extends through an opening in a bottom wall of the apron to engage the upper and lower flanges.

6. The sink of claim 5, wherein a shoulder extends upwardly from a top surface of the bottom wall of the apron, and the shoulder includes a bore that receives the fastener.

7. The sink of claim 3, wherein the panel assembly comprises:

at least one mount rail coupled to a backside of the panel, wherein each mount rail extends laterally across the backside of the panel;

a carrier disposed between each mount rail and the rear surface of the apron;

a first fastener coupling each mount rail to the carrier; and a second fastener coupling the carrier to the apron.

8. The sink of claim 7, wherein the first fastener extends in a first direction, the second fastener extends in a second direction, and the first and second directions are orthogonal.

9. The sink of claim 7, wherein:

the at least one mount rail includes first and second mount rails coupled to the backside of the panel and vertically offset from one another; and each of the first and second mount rails includes a pair of flanges, which protrude rearward and are separated by a channel.

10. A sink comprising:

a basin configured to hold water;

an apron extending from a front of the basin and having an upper wall, a lower wall, a first side wall, a second side wall, and a rear surface defining an opening in a front of the apron; and a panel assembly removably received in the opening and comprising:

a carrier detachably coupled to the apron with a first fastener;

and a panel detachably coupled to the carrier, wherein an outer perimeter of the panel assembly is spaced apart from the upper wall, the lower wall, the first side wall, and the second side wall of the apron.

11. The sink of claim 10, wherein the panel comprises a portion that is configured to be received in the opening.

12. The sink of claim 10, wherein the carrier is disposed between a portion of the panel and a portion of the apron when the carrier is coupled to the panel and the apron.

13. The sink of claim 10, wherein:

the opening is rectangular; and the panel is rectangular.

14. The sink of claim 10, wherein the panel comprises a plurality of bores, each of the plurality of bores configured to receive a portion of a second fastener for detachably coupling the panel to the carrier.

15. The sink of claim 10, wherein an outer perimeter of the panel is spaced apart from the upper wall, the lower wall, the first side wall, and the second side wall of the apron when the carrier is coupled to the apron and the panel.

16. The sink of claim 10, wherein:

the carrier contacts the apron when the carrier is coupled to the apron; and the carrier contacts the panel when the carrier is coupled to the panel.

17. The sink of claim 10, wherein the panel is made of at least one of a natural stone or a synthetic stone.

18. A sink comprising:

a basin configured to hold water;

an apron extending from a front of the basin and having a plurality of walls and a rear surface defining an opening in a front of the apron; and a panel assembly removably received in the opening and comprising:

a carrier detachably coupled to the apron with a first fastener;

and a panel detachably coupled to the carrier;

wherein the plurality of walls comprises an upper wall, a lower wall, a first side wall, and a second side wall;

wherein the panel comprises an upper wall, a lower wall, a first side wall, and a second sidewall;

wherein a first gap is formed between the upper wall of the panel and the upper wall of the apron when the carrier is coupled to the apron and the panel;

wherein a second gap is formed between the lower wall of the panel and the lower wall of the apron when the carrier is coupled to the apron and the panel;

wherein a third gap is formed between the first side wall of the panel and the first side wall of the apron when the carrier is coupled to the apron and the panel; and wherein a fourth gap is formed between the second side wall of the panel and the second side wall of the apron when the carrier is coupled to the apron and the panel.

19. The sink of claim 18, wherein at least two of the first gap, the second gap, the third gap, or the fourth gap are the same.

* * * * *